US010212989B2

(12) United States Patent
Inomata et al.

(10) Patent No.: US 10,212,989 B2
(45) Date of Patent: Feb. 26, 2019

(54) SHOE HAVING UPPER AND SOLE

(71) Applicant: ASICS CORPORATION, Kobe-shi (JP)

(72) Inventors: Takashi Inomata, Kobi (JP); Kenta Moriyasu, Kobe (JP); Kentaro Yamashita, Kobe (JP); Yousuke Atarashi, Kobe (JP)

(73) Assignee: ASICS CORPORATION (JP)

( * ) Notice: Subject to any disclaimer, the term of this patent is extended or adjusted under 35 U.S.C. 154(b) by 0 days.

(21) Appl. No.: 15/108,265

(22) PCT Filed: Oct. 8, 2015

(86) PCT No.: PCT/JP2015/078600
§ 371 (c)(1),
(2) Date: Apr. 13, 2017

(87) PCT Pub. No.: WO2017/061002
PCT Pub. Date: Apr. 13, 2017

(65) Prior Publication Data
US 2017/0238657 A1 Aug. 24, 2017

(51) Int. Cl.
*A43B 23/02* (2006.01)
*A43B 7/24* (2006.01)

(52) U.S. Cl.
CPC ..... *A43B 23/027* (2013.01); *A43B 7/24* (2013.01); *A43B 23/0275* (2013.01); *A43B 23/0265* (2013.01)

(58) Field of Classification Search
CPC ..... A43B 23/027; A43B 23/0275; A43B 23/0276; A43B 7/24
(Continued)

(56) References Cited

U.S. PATENT DOCUMENTS 1,548,172 A * 8/1925 Redden ..... A43B 7/20 36/53
2,147,197 A * 2/1939 Glidden ..... A43B 1/02 36/3 A
(Continued)

FOREIGN PATENT DOCUMENTS

JP 2008-543452 12/2008
JP 4957978 B2 6/2012
JP 5103639 B2 12/2012

OTHER PUBLICATIONS

English Translation of International Search Report Issued in PCT/JP2015/078600 dated Jan. 12, 2016.

*Primary Examiner* — Jameson Collier
*Assistant Examiner* — Jocelyn Bravo
(74) *Attorney, Agent, or Firm* — Katten Muchin Rosenman LLP

(57) ABSTRACT

A flexible member includes a reinforced area reinforced by first and second reinforcement portions, wherein: the area is defined by the posterior edge of a first reinforcement portion and the anterior edge of a second reinforcement portion; the first and second reinforcement portions are smoothly continuous with each other without gaps; the perimeter of the area is completely surrounded by the first and second reinforcement portions; the virtual first center line of the area extends obliquely forward and upward; and the angle formed between the first center line and the tread surface of the sole is about 40° to 55°.

9 Claims, 15 Drawing Sheets

(58) Field of Classification Search
USPC ..... 36/102
See application file for complete search history.

(56) References Cited

U.S. PATENT DOCUMENTS 4,410,385 A * 10/1983 Murphy ..... B29C 70/22 156/181
4,447,967 A * 5/1984 Zaino ..... A43B 23/0235 36/45
5,155,927 A 10/1992 Bates et al.
5,493,792 A 2/1996 Bates et al.
5,692,319 A * 12/1997 Parker ..... A43B 7/1495 36/114
5,718,063 A 2/1998 Yamashita et al.
D416,381 S 11/1999 Senda et al.
6,199,302 B1 3/2001 Kayano
6,212,795 B1 4/2001 Nakabe et al.
6,255,235 B1 7/2001 Hiraoka et al.
6,438,870 B2 8/2002 Nasako et al.
6,467,191 B2 10/2002 Hayashi et al.
6,467,197 B1 10/2002 Mitsui et al.
6,516,539 B2 2/2003 Nishiwaki et al.
6,562,271 B2 5/2003 Hiraoka et al.
6,647,646 B2 11/2003 Mitsui et al.
6,685,011 B2 2/2004 Nishiwaki et al.
6,763,615 B2 7/2004 Mitsui et al.
D495,859 S 9/2004 Kubo et al.
D495,860 S 9/2004 Kubo et al.
D496,148 S 9/2004 Kayano et al.
6,789,333 B2 9/2004 Nishiwaki et al.
D501,713 S 2/2005 Kayano et al.
D501,987 S 2/2005 Kubo et al.
D509,351 S 9/2005 Kayano et al.
D512,208 S 12/2005 Kubo et al.
D512,818 S 12/2005 Mitani et al.
D512,819 S 12/2005 Usuki et al.
D512,827 S 12/2005 Usuki et al.
D512,828 S 12/2005 Kubo et al.
D513,115 S 12/2005 Kayano et al.
D514,286 S 2/2006 Kayano et al.
D518,283 S 4/2006 Kayano et al.
D520,732 S 5/2006 Mitani et al.
D522,229 S 6/2006 Kubo et al.
D527,174 S 8/2006 Kayano et al.
7,082,699 B2 8/2006 Nishiwaki et al.
D527,516 S 9/2006 Kayano et al.
D528,761 S 9/2006 Kayano et al.
D542,522 S 5/2007 Fujita et al.
7,254,907 B2 8/2007 Nishiwaki et al.
D552,833 S 10/2007 Yamashita et al.
D553,846 S 10/2007 Kayano et al.
7,322,131 B2 1/2008 Yamashita et al.
D561,434 S 2/2008 Fujita et al.
D561,442 S 2/2008 Kayano et al.
7,325,323 B2 2/2008 Katsu et al.
D571,086 S 6/2008 Yamashita et al.
D571,090 S 6/2008 Fujita et al.
D575,486 S 8/2008 Yamashita et al.
D575,946 S 9/2008 Mitani et al.
D582,658 S 12/2008 Fujita et al.
7,613,588 B2 11/2009 Katsu et al.
7,779,558 B2 8/2010 Nishiwaki et al.
7,823,298 B2 11/2010 Nishiwaki et al.
7,877,899 B2 2/2011 Nishiwaki et al.
7,987,618 B2 8/2011 Nishiwaki et al.
8,008,363 B2 8/2011 Mori et al.
D650,566 S 12/2011 Yamashita et al.
8,074,377 B2 12/2011 Nishiwaki et al.
8,112,909 B2 2/2012 Kubo et al.
D659,371 S 5/2012 Yano et al.
8,266,827 B2 9/2012 Dojan et al.
8,272,148 B2 9/2012 Nishiwaki et al.
8,388,791 B2 3/2013 Dojan et al.
8,418,379 B2 4/2013 Nishiwaki et al.
8,453,344 B2 6/2013 Nishiwaki et al.
8,461,222 B2 6/2013 Mori et al.
8,544,190 B2 10/2013 Nishiwaki et al.
8,667,713 B2 * 3/2014 Baudouin ..... A43B 7/1495 36/102
8,713,821 B2 5/2014 Nishiwaki et al.
D734,927 S 7/2015 Ando et al.
D734,928 S 7/2015 Ando et al.
9,089,185 B2 7/2015 Nishiwaki et al.
9,259,054 B2 2/2016 Nishiwaki et al.
2004/0118018 A1 * 6/2004 Dua ..... A43B 1/04 36/45
2005/0193592 A1 * 9/2005 Dua ..... A43B 1/04 36/45
2006/0028042 A1 2/2006 Maeshima et al.
2009/0014424 A1 * 1/2009 Meschter ..... A41D 31/02 219/121.69
2010/0083535 A1 * 4/2010 Meschter ..... A43B 7/1495 36/88
2010/0154256 A1 * 6/2010 Dua ..... A43B 1/04 36/25 R
2011/0113648 A1 * 5/2011 Leick ..... A43B 1/0081 36/50.1
2011/0197468 A1 8/2011 Kubo et al.
2011/0271555 A1 * 11/2011 Baudouin ..... A43B 7/1495 36/88
2012/0124866 A1 5/2012 Moriyasu et al.
2012/0216422 A1 8/2012 Ikezawa et al.
2013/0008053 A1 * 1/2013 Nishiwaki ..... A43B 23/0255 36/102
2013/0333251 A1 12/2013 Taniguchi et al.
2014/0237858 A1 * 8/2014 Adami ..... A43B 23/0205 36/107
2015/0013080 A1 * 1/2015 Thomas ..... A43B 1/04 12/142 R
2015/0013187 A1 1/2015 Taniguchi et al.
2015/0082668 A1 3/2015 Nonogawa et al.
2015/0135558 A1 5/2015 Inomata et al.
2015/0143723 A1 5/2015 Tateishi et al.
2015/0181975 A1 7/2015 Otsuka et al.
2015/0230546 A1 * 8/2015 Zasloff ..... A43B 9/16 36/30 R
2015/0250260 A1 9/2015 Bessho et al.
2015/0282559 A1 10/2015 Nishiwaki et al.
2015/0289589 A1 10/2015 Nishiwaki et al.
2016/0015122 A1 1/2016 Nishiwaki et al.
2016/0113353 A1 4/2016 Tateishi
2016/0113354 A1 4/2016 Tateishi
2016/0174661 A1 * 6/2016 Nonogawa ..... A43B 1/04 36/88
2017/0143075 A1 * 5/2017 Nonogawa ..... A43B 7/28

* cited by examiner

X
3
13
23
2
4R
42
(4)
C1
24
14
1
4F
41(4)
89
α
F
8F
83
X
FE
30～40%
45～55%
100%

SHOE HAVING UPPER AND SOLE

CROSS-REFERENCE TO RELATED APPLICATION

The present application claims priority to and is a national stage application, filed under 35 U.S.C. § 371, of International Application No. PCT/JP2015/078600, filed on Oct. 8, 2015, the contents of which fully incorporated herein by reference in its entirety.

TECHNICAL FIELD

The present invention relates primarily to a shoe with an improved function of suppressing overpronation while running.

BACKGROUND ART

The function of suppressing overpronation while running is called "stability (performance)". Such stability performance is regarded as one of the most important functions for a running shoe. Techniques known in the art for suppressing the overpronation include a structure in which a high-hardness member is provided on the medial side of the midsole (U.S. Pat. No. 6,199,302 B1), and a reinforcement unit placed in the middle foot portion of the sole so as to suppress the torsional deformation of the sole.

CITATION LIST

Patent Literature

First Patent Document: U.S. Pat. No. 6,199,302 B1 (FIG. 9)

Second Patent Document: U.S. Pat. No. 8,266,827 B2 (FIG. 7A)

Third Patent Document: U.S. Pat. No. 8,388,791 B2 (FIG. 1)

SUMMARY OF INVENTION

Runners trying to improve their best times for a full marathon may run a distance of 20 to 30 km in a single training session. According to our experimental results, it was found that even when running with shoes of which the midsole on the medial side is reinforced, the eversion angle of the heel portion increases while running a long distance of 10 km or more.

FIG. 11A shows the change in the eversion angle β of the heel portion immediately after landing. As changes in the eversion angle β, there appear two peaks, one between 0 and 0.1 sec after landing, and another between 0.1 and 0.2 sec after landing. It is believed that the former (the first peak P11) is a deformation that is caused by the eversion of the heel portion immediately after landing. On the other hand, it is believed that the latter (the second peak P12) is a deformation that is caused by the arch on the medial side collapsing (flattening), thereby collapsing the entire foot toward the medial side.

FIG. 11B shows the relationship between the peak value of the second peak P12 of the eversion angle β and the running distance. As can be seen from FIG. 11B, the absolute value of the eversion angle β tends to gradually increase as the running distance increases.

It is believed that such a phenomenon occurs as the muscular fatigue of the foot, etc., from running decreases the muscular power, thereby lowering the function of supporting (retaining) the foot bone structure, particularly, the arch.

On the other hand, if the reinforcement unit for reinforcing the midsole on the medial side is made too hard, or if the hardness of the midsole itself on the medial side is increased too much, it will cause an upthrust to be felt on the sole of the foot.

In the shoes disclosed in U.S. Pat. No. 8,266,827 B2 and U.S. Pat. No. 8,388,791 B2, many strands are placed on the side surface of the upper. These conventional examples aim to decrease the mass of the footwear and improve the production efficiency. That is, they do not aim to improve the stability performance, and it will be difficult for them to make such improvements.

It is an object of the present invention to improve the structure of the upper, thereby improving the function of suppressing overpronation while running, i.e., the stability performance.

Before describing the structure of the present invention, the principle of the present invention will be explained.

FIG. 12A and FIG. 12B show how the upper deforms after running 1 km (0.625 miles) and 15 km (9.375 miles), respectively. In these figures, areas where the upper was stretched are dotted.

It can be seen that the upper is stretched more after running 15 km as shown in FIG. 12B than after running 1 km as shown in FIG. 12A. Particularly, a comparison between the figures indicates that there is a greater stretch (elongation) in an area of the upper covering the arch of the foot on the medial side of the forefoot section as shown in FIG. 12B.

FIG. 13A shows the relationship between the stretch (strain) of the upper in the area of the arch and the eversion angle β of the heel portion. It can be seen in FIG. 13A that the absolute value of the eversion angle β increases as the stretch of the upper in the area of the arch increases.

It is believed that there is such a correlation as the muscular fatigue of the foot from running a long distance lowers the function of retaining the arch of the foot, thereby causing overpronation so that the first toe collapsing on the medial side pushes the medial side portion of the upper. Therefore, it will be possible to prevent the overpronation by increasing the stiffness of the area of the upper that is stretched.

We measured the angle γ formed between the direction Da in which the upper is stretched in FIG. 12B and a tread surface (contact surface) 8F of a sole 8. As the angle γ is about 46.7°±7.1° on average, it is estimated that it is possible to effectively suppress the overpronation by placing a reinforcement member over a range of 30° to 60°, taking individual differences into consideration.

On the other hand, running shoes having an upper made by using a meshed material were worn to measure the stretch of the upper in the area while the wearer is not fatigued. The average value of the stretch was about 4.7%±1.1%. Therefore, in order to tolerate such a stretch, the material preferably has such characteristics that the stiffness thereof increases after there is a stretch of about 3 to 6%.

An upper formed by a material that has such material characteristics will realize a soft feel for a wearer until it starts exerting the stiffness, while being able to suppress the collapse (pronation) of the foot in a phase where support is needed.

FIG. 14A shows a foot during kick-off (kicking phase), i.e., from heel-rise to toe-off, while running barefoot. In this figure, areas that are substantially stretched are dotted. The greater the stretch is, the more densely the area is dotted. In this figure, an arrow indicates the direction Df in which the surface of the foot stretches during kick-off.

It can be seen that the direction Df of FIG. 14A in which the surface of the foot stretches crosses, at a large angle, the direction Da of FIG. 12B in which the upper is stretched as if the directions were perpendicular. Therefore, it is estimated that for the area of the upper that covers the arch of the foot on the medial side of the forefoot section, there is required such a stretch property that it stretches less easily in the direction Da of FIG. 12B while stretching more easily in the direction Df, which is generally perpendicular to the direction Da.

The stretch (elongation) of the surface of the foot was measured at points P1 to P8, which are arranged in line in FIG. 14A. FIG. 14B is a bar chart showing the measurement results.

The measurement point P8 of FIG. 14A is located generally at the boundary between the sole (arch) of the foot and the medial side surface of the foot. On the other hand, the points P5 and P6 are located at a lower portion of the shaft (body of bone) B11 of the first metatarsal bone B1 of FIG. 12B, slightly above the arch, or directly below the shaft B11.

With respect to the direction Df of FIG. 14A, areas where the surface of the foot is stretched are the measurement points P5 and P6 of FIG. 14A, as can be seen from the bar chart of FIG. 14B. Therefore, the surface of the foot is stretched in the direction Df at a lower portion of the shaft B11 of the first metatarsal bone B1 of FIG. 12B, or directly below the shaft B11. Therefore, in such an area, a material property required of the upper is that it easily stretches in a rearward-upward diagonal direction (obliquely rearward and upward). This will maintain or improve the fitting property of the upper in such an area.

A first aspect of the present invention is directed to a shoe including an upper 3 and a sole 8, the shoe including:

a flexible member 30 forming (composing) a part of the upper 3 and covering a medial side surface of a foot; and a first reinforcement portion 1 and a second reinforcement portion 2, each being less stretchable than the flexible member 30 and each attached to a surface 3F of the flexible member, wherein:

the flexible member 30 includes a reinforced area 4 reinforced by the first and the second reinforcement portions 1 and 2;

the first reinforcement portion 1 continuously or intermittently extends, in a band-shaped (strap-shaped, or belt-shaped) form (pattern) or a linear-shaped form (pattern), upward from a boundary portion 38 of the upper 3 with respect to the sole 8;

the second reinforcement portion 2 is placed posterior R to the first reinforcement portion 1 and continuously or intermittently extends, in a band-shaped (strap-shaped, or belt-shaped) form (pattern) or a linear-shaped form (pattern), upward from a boundary portion 38 of the upper 3 with respect to the sole 8;

the area 4 is defined by a first envelope line (envelope) 1L along a posterior edge 1E of the first reinforcement portion and a second envelope line (envelope) 2L along an anterior edge 2E of the second reinforcement portion;

the area 4 extends along a virtual first center line C1, which divides the area 4 into a first portion 41 whose anterior edge 4F is defined by the first envelope line and a second portion 42 whose posterior edge 4R is defined by the second envelope line;

the area 4 includes an upper end portion 43, a lower end portion 44, and an intermediate portion 45 between the upper end portion 43 and the lower end portion 44;

a width 4W of the area in a direction D2 perpendicular to a direction D1 along which the first center line C1 extends is at maximum in the intermediate portion 45, the width 4W of the area gradually decreasing as the area extends toward the upper end portion 43 from the intermediate portion 45, and the width 4W of the area gradually decreasing as the area extends toward the lower end portion 44 from the intermediate portion 45; and the upper end portion 43 of the area 4 is placed anterior to the lower end portion 44 of the area 4.

In this first aspect, the upper end portion of the reinforced area 4 is placed anterior to the lower end portion. Thus, the first center line C1 extends in a forward-upward diagonal direction (obliquely forward and upward), and therefore the upper covering the medial side surface of the foot may stretch less easily in the direction Da in which the upper is stretched. This may possibly suppress the overpronation.

In this first aspect, the width of the direction D2 perpendicular to the first center line C1 is at maximum in the intermediate portion 45, and gradually decreases toward the upper end portion and the lower end portion of the reinforced area 4.

Therefore, in the intermediate portion 45 of the area 4, it stretches easily in the direction D2 perpendicular to the first center line C1. This may possibly maintain or improve the fitting property of the upper.

In the present invention, the surface 3F of the flexible member 30 does not only mean the outer surface of the upper but also includes the inner surface thereof to be in contact with the foot.

The "first center line C1" may be a virtual line that generally equally divides the area 4 into a first portion 41 and a second portion 42.

The "boundary portion 38 of the upper 3 with respect to the sole 8" includes an area of the upper near the boundary as well as the boundary itself. "Upward from a boundary portion" includes obliquely upward from the boundary portion.

"Continuously or intermittently" refers to cases where one reinforcement portion is divided into a plurality of portions, as well as cases where each of the reinforcement portions 1 and 2 is completely continuous. This is because even if the reinforcement portion is divided into a plurality of portions, the stretch (elongation) of the flexible member 30 in the direction in which the reinforcement portion extends is suppressed if the reinforcement portion extends substantially continuously in a band-shaped form or a linear-shaped form.

The "band-shaped form" means that the width and the thickness of a reinforcement portion are sufficiently smaller than the length of the reinforcement portion in the direction in which it extends. On the other hand, the "linear-shaped form" includes a thread-like material that is thinner than a band-shaped material, such as a cotton thread or a nylon thread, which is less stretchable (hard to be stretched), sewn onto the upper.

The "envelope line (envelope)" means a curve that shares a tangent with a given family of curves, i.e., a curve that is in contact with all of a given (typically infinite) number of curves. Where the posterior edge 1E of the first reinforcement portion 1 or the anterior edge 2E of the second reinforcement portion 2 is composed of a straight line and a curve that are smoothly continuous with each other, the first and second envelope lines 1L and 2L will generally coincide respectively with the posterior edge 1E of the first reinforcement portion 1 and the anterior edge 2E of the second reinforcement portion 2.

A second aspect of the present invention is directed to a shoe including an upper 3 and a sole 8, the shoe including:

a flexible member 30 forming (composing) a part of the upper 3 and adapted to cover a medial side surface of a foot; and a first reinforcement portion 1 and a second reinforcement portion 2, each being less stretchable than the flexible member 30 and each attached to a surface 3F of the flexible member, wherein:

the first reinforcement portion 1 continuously or intermittently extends, in a band-shaped form (pattern) or a linear-shaped form (pattern), upward from a boundary portion 38 of the upper 3 with respect to the sole 8;

the second reinforcement portion 2 is placed posterior R to the first reinforcement portion 1 and continuously or intermittently extends, in a band-shaped form (pattern) or a linear-shaped form (pattern), upward from the boundary portion 38 of the upper 3 with respect to the sole 8;

a first envelope line (envelope) 1L along a posterior edge 1E of the first reinforcement portion includes a first bend point O1 at which the first envelope line 1L bends, the first bend point O1 located above the boundary portion 38 and below an upper edge 3E of the upper 3;

a second envelope line (envelope) 2L along an anterior edge 2E of the second reinforcement portion includes a second bend point O2 at which the second envelope line 2L bends, the second bend point O2 located above the boundary portion 38 and below an upper edge 3E of the upper 3;

the first reinforcement portion 1 and the second reinforcement portion 2 come gradually closer to each other as the first envelope line 1L extends upward from the first bend point O1 and the second envelope line 2L extends upward from the second bend point O2;

the first reinforcement portion 1 and the second reinforcement portion 2 come gradually closer to each other as the first envelope line 1L extends downward from the first bend point O1 and the second envelope line 2L extends downward from the second bend point O2;

a lower end 14 of the first reinforcement portion and a lower end 24 of the second reinforcement portion are adapted to a position of an arch on a medial side of the foot;

an upper end 13 of the first reinforcement portion is adapted to a position of a ball O of a big toe or posterior to the ball O of the big toe; and the upper end 13 of the first reinforcement portion is placed anterior F to the lower end 14 of the first reinforcement portion, and/or an upper end 23 of the second reinforcement portion 2 is placed anterior F to the lower end 24 of the second reinforcement portion.

In this second aspect, the upper end 13 of the first reinforcement portion is placed anterior to the lower end 14 of the first reinforcement portion, and/or the upper end 23 of the second reinforcement portion is placed anterior to the lower end 24 of the second reinforcement portion. Therefore, the first and/or second reinforcement portions extend in a forward-upward diagonal direction (obliquely forward and upward), and the upper covering the medial side surface of the foot may therefore stretch less easily in the direction Da in which the upper is stretched. This may possibly suppress the overpronation.

The respective lower ends 14 and 24 of the first and second reinforcement portions are adapted to the position of the arch on the medial side of the foot, and the upper end 13 of the first reinforcement portion is adapted to the position of the ball O of the big toe or posterior to the ball O of the big toe. Therefore, the reinforcement portions 1 and 2 can possibly reinforce the area of the upper where a substantial stretch has occurred while running a long distance. This will suppress the overpronation.

A third aspect of the present invention is directed to a shoe including an upper 3 and a sole 8, the shoe including:

a flexible member 30 forming (composing) a part of the upper 3 and adapted to cover a medial side surface of a foot; and a first reinforcement portion 1 and a second reinforcement portion 2, each being less stretchable than the flexible member 30 and each attached to a surface 3F of the flexible member, wherein:

the first reinforcement portion 1 continuously or intermittently extends, in a band-shaped form (pattern) or a linear-shaped form (pattern), upward from a boundary portion 38 of the upper 3 with respect to the sole 8;

the second reinforcement portion 2 is placed posterior R to the first reinforcement portion 1 and continuously or intermittently extends, in a band-shaped form (pattern) or a linear-shaped form (pattern), upward from the boundary portion 38 of the upper 3 with respect to the sole 8;

a first envelope line (envelope) 1*b* along a posterior edge 1E of the first reinforcement portion includes a first bend point O1 at which the first envelope line 1L bends, the first bend point O1 located above the boundary portion 38 and below an upper edge 3E of the upper 3;

a second envelope line (envelope) 2L along an anterior edge 2E of the second reinforcement portion includes a second bend point O2 at which the second envelope line 2L bends, the second bend point O2 located above the boundary portion 38 and below the upper edge 3E of the upper 3;

the first reinforcement portion 1 and the second reinforcement portion 2 come gradually closer to each other as the first envelope line 1L extends upward from the first bend point O1 and the second envelope line 2L extends upward from the second bend point O2;

the first reinforcement portion 1 and the second reinforcement portion 2 come gradually closer to each other as the first envelope line 1L extends downward from the first bend point O1 and the second envelope line 2L extends downward from the second bend point O2;

a lower end 14 of the first reinforcement portion and a lower end 24 of the second reinforcement portion are placed within a range of 40% to 60% of an entire length of the shoe, as measured from a front end FE of the shoe in a front-rear direction X;

an upper end 13 of the first reinforcement portion and an upper end 23 of the second reinforcement portion are placed within a range of 25% to 45% of the entire length of the shoe, as measured from the front end FE; and the upper end 13 of the first reinforcement portion is placed anterior F to the lower end 14 of the first reinforcement portion, and the upper end 23 of the second reinforcement portion 2 is placed anterior F to the lower end 24 of the second reinforcement portion.

In this third aspect, the lower ends 14 and 24 of the reinforcement portions are placed within a range of 40% to 60% of the entire length of the shoe, as measured from the front end FE of the shoe in the front-rear direction X. Then, the lower ends 14 and 24 are likely to be adapted to the position of the arch on the medial side of the foot.

Therefore, the lower ends of the reinforcement portions 1 and 2 adapted to the position of the arch on the medial side of the foot will be pulled in a forward-upward diagonal direction (obliquely forward and upward). Therefore, the upper stretches less easily in an intended direction, and the pronation-suppressing function will likely be exerted.

In this third aspect, the upper end 13 of the first reinforcement portion is placed anterior to the lower end 14 of the first reinforcement portion, and the upper end 23 of the second reinforcement portion is placed anterior to the lower end of the second reinforcement portion. With such an arrangement, the two reinforcement portions will each extend in a forward-upward diagonal direction from an area adapted to the arch on the medial side of the foot.

Moreover, in this third aspect, the upper ends 13 and 23 of the first and second reinforcement portions are placed within a range of 25% to 45% of the entire length of the shoe, as measured from the front end FE.

If the upper ends and the lower ends of the reinforcement portions are placed within such a range, and if the upper ends are anterior to the lower ends, the lower ends of the reinforcement portions will be adapted to the arch on the medial side of the foot and the lower ends of the reinforcement portions will be pulled in a forward-upward diagonal direction. Therefore, the pronation-suppressing function will likely be exerted.

In the second and third aspects, as the first envelope line 1L and the second envelope line 2L extend upward from the first and second bend points O1 and O2, respectively, the first reinforcement portion 1 and the second reinforcement portion 2 come gradually closer to each other. And as the first envelope line 1L and the second envelope line 2L extend downward from the first and second bend points O1 and O2, respectively, the first reinforcement portion 1 and the second reinforcement portion 2 come gradually closer to each other. Therefore, the area reinforced by the reinforcement portions 1 and 2 will stretch easily along the straight line connecting between the bend points O1 and O2. This may possibly maintain or improve the fitting property of the upper.

In the present invention, the meaning of "being adapted" is generally equal to "being placed".

A fourth aspect of the present invention is directed to a shoe having an upper 3 covering a foot, including:

a flexible member 30 forming a part of the upper 3 and adapted to cover a medial side surface of a forefoot section; and reinforcement portions 1 and 2 being less stretchable than the flexible member 30 and attached to a surface 3F of the flexible member 30, wherein:

the reinforcement portions 1 and 2 extend in an rearward-downward diagonal direction from upper first end portions 11 and 12 thereof toward lower second end portions 21 and 22 thereof;

an angle α formed between a virtual straight line SL, which passes through the first end portions 11 and 12 and the second end portions 21 and 22, and a tread surface 8F of the sole is set to 30° to 60°; and a stiffness of a virtual area VA including the flexible member 30 and the reinforcement portions satisfies the following conditions (a) to (c):

(a) where the virtual area VA is defined by a pair of vertical lines S1 extending along the virtual straight line SL and a pair of horizontal lines S2 extending along another straight line perpendicular to the virtual straight line, a test specimen S having a rectangular shape thus defined is used;

(b) the first end portions 11 and 12 and the second end portions 21 and 22 are clamped by a tensile tester 100 and a tensile load is applied thereon in a direction in which the virtual straight line SL extends; and (c) a tensile stiffness of the test specimen S increases when a stretch of the test specimen S exceeds an arbitrary value of 3% to 6%.

On the medial side of the forefoot section, the angle α formed between the virtual straight line SL, which passes through the first end portions 11 and 12 and the second end portions 21 and 22 of the reinforcement portions extending obliquely rearward and downward, and the tread surface 8F of the sole (FIG. 2) is set to 30° to 60°. If the angle α is set within such a range, the upper will stretch less easily in the direction Da in which the upper is stretched. Thus, it is possible to suppress the overpronation.

The tensile stiffness of the test specimen S increases when the stretch of the test specimen S exceeds an arbitrary value of 3% to 6%. This allows for a small stretch, which is needed for the upper, thus realizing a soft feel on the foot, when running while the wearer is not fatigued. On the other hand, after the wearer is fatigued, the upper stretches less easily and it is possible to suppress the collapse of the foot.

DESCRIPTION OF EMBODIMENTS

Figure 1:
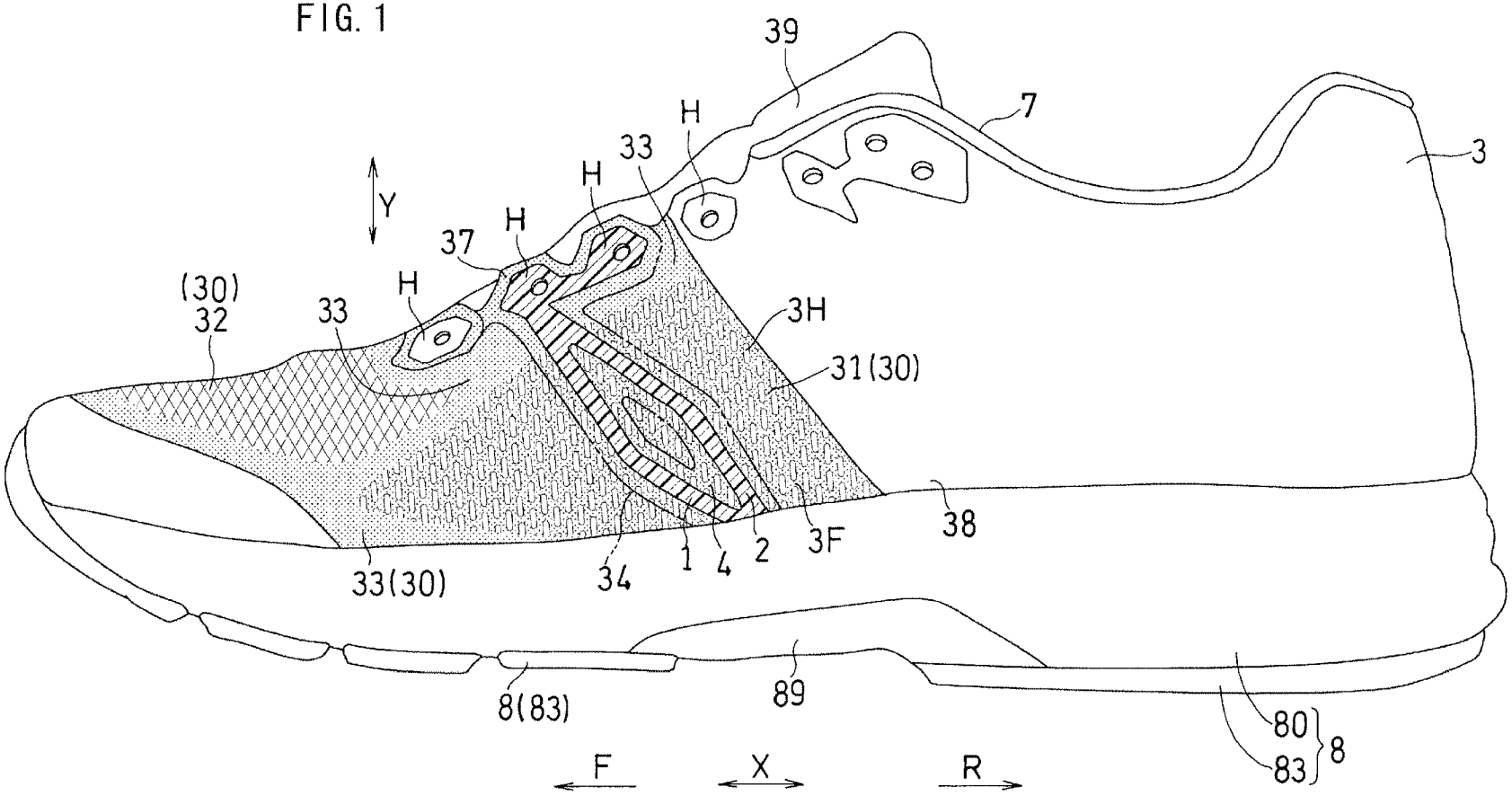
FIG. 1 is a schematic medial side view showing a shoe according to Embodiment 1 of the present invention.

Preferably, in a reinforced area 4 where the flexible member 30 is reinforced by the first and second reinforcement portions 1 and 2, at least a surface member of the flexible member includes a meshed fabric (mesh fabric) that can stretch and shrink (stretchable) in an up-down direction Y and in a front-rear direction X of the shoe.

Such a meshed fabric will improve the fitting property of the upper in the reinforced area 4, of which the deformation is restrained (restricted) by the reinforcement portions 1 and 2.

More preferably, the meshed fabric stretches and shrinks more easily in the front-rear direction X than in the up-down direction Y.

With the meshed fabric stretching/shrinking more easily in the front-rear direction, the fabric stretches easily in the direction in which the surface of the foot stretches during kick-off, which will further improve the fitting property.

On the other hand, if the meshed fabric stretches less easily in the up-down direction than in the front-rear direction, this fabric, together with the reinforcement portions 1 and 2, will make the upper less stretchable in the up-down direction, and the overpronation will likely be suppressed.

The meshed fabric may include many through holes that can be visually observed. The shape of the through holes may be oblong circular, elliptical, circular or diamond-shaped. The material of the meshed fabric may be a synthetic fiber or a natural fiber.

Preferably, in the first aspect, a length 4L of the area 4 in a direction D1 along which the virtual first center line C1 extends is greater than the maximum width 4W of the area 4, the virtual first center line C1 dividing the reinforced area 4 into an anterior portion and a posterior portion.

Where the length of the reinforced area 4 is greater than the width 4W of the reinforced area 4, the reinforced area 4 stretches less easily in the direction D1 in which the center line extends, whereas it stretches easily in the width direction, i.e., the front-rear direction. Therefore, one can expect further improvements to the pronation-suppressing property and the fitting property.

Preferably, in the second aspect and the third aspect, the flexible member 30 includes a reinforced area 4 defined by the first envelope line 1L and the second envelope line 2L, and a length 4L of the area 4 in a longitudinal direction perpendicular to a direction extending from the first bend point (first bending point) O1 toward the second bend point (second bending point) O2 is greater than a width 4W of the area 4 between the first bend point (the first bending point) O1 and the second bend point (the second bending point) O2.

Where the length 4L between the upper and lower ends of the reinforcement portions is greater than the width 4W between the bend points, as described above, one can expect further improvements to the overpronation suppressing function and the fitting property.

Preferably, in the first aspect, an angle $\alpha$ formed between the first center line C1 and a tread surface 8F of the sole is set to 30° to 60°. Note that the "angle formed between a line and the tread surface 8F of the sole" means the acute angle formed anterior to the line or the vertical angle thereof.

Preferably, in the second and third aspects, an angle $\alpha$ formed between a virtual second center line C2 and a tread surface 8F of the sole 8 is set to 30° to 60°, wherein the virtual second center line C2 extends from a midpoint O3 of a virtual line segment connecting between the first bend point O1 and the second bend point O2 to a point O4 included in an upper end 13 of the first reinforcement portion 1 and an upper end 23 of the second reinforcement portion 2 (or to a point O4 between the upper ends 13 and 23). Note that the "second center line C2" may be a virtual line that generally equally divides the upper half of the area 4.

As described above, the direction Da in which the upper is stretched will be 46.7°±7.1° with respect to the tread surface. Therefore, where the angle $\alpha$ is set to 30° to 60°, the function of suppressing the stretch of the upper will be high, and the overpronation suppressing function will be improved.

In one shoe, the first center line C1 and the second center line C2 will essentially coincide (conform) with each other.

Preferably, in the first, second and third aspects, an upper end 13 of the first reinforcement portion 1 and an upper end 23 of the second reinforcement portion 2 are adjacent to, or continuous with, an engagement portion H with which a shoelace engages, and a lower end 14 of the first reinforcement portion 1 and a lower end 24 of the second reinforcement portion 2 are adjacent to, or continuous with, an upper surface 81 of the sole 8.

In such a case, the first and second reinforcement portions 1 and 2 extend over a great length, over the entire extent or the majority of the extent from the engagement portion H with which the shoelace engages to the upper surface 81 of the sole 8. Therefore, the function of suppressing the stretch of the upper will be high, and the overpronation suppressing function will be improved.

The "engagement portion H" has an eyelet hole or a loop through which the shoelace passes, and includes an eyelet member (eyelet ornament) or a U-shaped tube with which the shoelace engages.

Preferably, in the first aspect, the first and the second reinforcement portions 1 and 2 are placed while the virtual first center line C1 is adapted to cross a shaft B11 of a first metatarsal bone B1, as seen in a side view.

Preferably, in the second aspect, the first and second reinforcement portions 1 and 2 are placed while the virtual second center line C2 is adapted to cross a shaft B11 of a first metatarsal bone B1, as seen in a side view.

The area of the upper covering the shaft of the first metatarsal bone receives a large tensile force between the engagement portion with which the shoelace engages and the sole 8 during kick-off. Against such a large tensile force, the reinforcement portions 1 and 2 suppress the stretch of the upper. Therefore, the overpronation suppressing function will be improved.

Preferably, in the first aspect, a lower end 14 of the first reinforcement portion and a lower end 24 of the second reinforcement portion are adapted to a position of an arch on a medial side of the foot, and an upper end 13 of the first reinforcement portion is adapted to a position of a ball O of a big toe or posterior R to the ball O of the big toe; and the upper end 13 of the first reinforcement portion is placed anterior to the lower end 14 of the first reinforcement portion, and/or an upper end 23 of the second reinforcement portion is placed anterior to the lower end 24 of the second reinforcement portion.

In such a case, the lower ends of the reinforcement portions 1 and 2 adapted to the position of the arch on the medial side of the foot will be pulled in a forward-upward diagonal direction. Therefore, the lowering of the arch will be suppressed, and the overpronation suppressing function will easily be exerted.

Preferably, in the first and second aspects, a lower end 14 of the first reinforcement portion and a lower end 24 of the second reinforcement portion are placed within a range of 40% to 60% of an entire length of the shoe, as measured from a front end FE of the shoe in a front-rear direction X;

an upper end 13 of the first reinforcement portion and an upper end 23 of the second reinforcement portion are placed within a range of 25% to 45% of the entire length of the shoe, as measured from the front end FE; and the upper end 13 of the first reinforcement portion is placed anterior to the lower end 14 of the first reinforcement portion, and the upper end 23 of the second reinforcement portion is placed anterior to the lower end 24 of the second reinforcement portion.

If the upper ends and the lower ends of the reinforcement portions are placed within such a range, and if the upper ends are anterior to the lower ends, the lower ends of the reinforcement portions will be adapted to the arch on the medial side of the foot and the lower ends of the reinforcement portions will be pulled in a forward-upward diagonal direction. Therefore, the lowering of the arch will be suppressed, and the overpronation suppressing function will easily be exerted.

In the present invention, if the lower ends 14 and 24 of the reinforcement portions are placed at a position that is less than 40% from the front end FE, or if the position of the lower ends 14 and 24 is placed at a position over 60% from the front end FE, the lower ends will unlikely be adapted to the arch on the medial side.

If the upper ends 13 and 23 of the reinforcement portions are placed at a position less than 25% from the front end FE, the angle $\alpha$ may be too small. On the other hand, if the upper ends 13 and 23 of the reinforcement portions are placed at a position over 45% from the front end FE, the angle $\alpha$ may be too large.

In view of this, preferably, in the first to third aspects, a lower end 14 of the first reinforcement portion and a lower end 24 of the second reinforcement portion are placed within a range of 45% to 55% of an entire length of the shoe, as measured from a front end FE of the shoe in a front-rear direction X;

an upper end 13 of the first reinforcement portion and an upper end 23 of the second reinforcement portion are placed within a range of 30% to 40% of the entire length of the shoe, as measured from the front end FE; and the upper end 13 of the first reinforcement portion is placed anterior to the lower end 14 of the first reinforcement portion, and the upper end 23 of the second reinforcement portion is placed anterior to the lower end 24 of the second reinforcement portion.

In such a case, the respective lower ends 14 and 24 of the first and the second reinforcement portions are placed within the range of 45% to 55%, as measured from the front end FE of the shoe in the front-rear direction X, and the respective upper ends 13 and 23 of the first and the second reinforcement portions are placed within the range of 30% to 40%, as measured from the front end FE.

With the upper ends and the lower ends of the reinforcement portions placed within such a range, the first and second center lines C1 and C2 and the intermediate portion 45 of the reinforced area 4 will likely be placed so as to be adapted to the shaft B11 of the first metatarsal bone B1. Therefore, the overpronation suppressing function will more easily be exerted.

The upper end 13 of the first reinforcement portion is placed anterior to the lower end 14 of the first reinforcement portion, and the upper end 23 of the second reinforcement portion is placed anterior to the lower end 24 of the second reinforcement portion. With such an arrangement, the first and second reinforcement portions will both extend in a forward-upward diagonal direction so as to cross the shaft B11 of the first metatarsal bone B1. Thus, one can expect further improvements to the stability performance and the fitting property.

Preferably, in the second aspect, an angle $\alpha$1 (interior angle) formed between the first reinforcement portion 1 and the second reinforcement portion 2, measured by an upper end 13 of the first reinforcement portion and an upper end 23 of the second reinforcement portion, is an acute angle;

an angle $\alpha$2 (interior angle) formed between the first reinforcement portion 1 and the second reinforcement portion 2, measured by a lower end 14 of the first reinforcement portion 1 and a lower end 24 of the second reinforcement portion 2, is an acute angle;

an angle $\alpha$3 (interior angle) formed by the first reinforcement portion 1 at the first bend point O1 is an obtuse angle; and an angle $\alpha$4 (interior angle) formed by the second reinforcement portion 2 at the second bend point O2 is an obtuse angle.

In such a case, the first and second reinforcement portions are formed in a diamond shape (rhombus) that is elongated in an oblique up-down direction. When a tension acts on a flexible member including the reinforcement portions in an oblique up-down direction, the acute angles $\alpha$1 and $\alpha$2 will decrease, and the flexible member will slightly stretch in the oblique up-down direction. On the other hand, when a tension acts on a flexible member including the reinforcement portions in the width direction perpendicular to the oblique up-down direction, the obtuse angles $\alpha$3 and $\alpha$4 will decrease, and the flexible member will stretch relatively substantially. Such an anisotropy will improve both the stability performance and the fitting property.

Any feature illustrated and/or depicted in conjunction with one of the aforementioned aspects or the following embodiments may be used in the same or similar form in one or more of the other aspects or other embodiments, and/or may be used in combination with, or in place of, any feature of the other aspects or embodiments.

Embodiments

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

Embodiment 1

Embodiment 1 of the present invention will now be described with reference to FIG. 1 to FIG. 6.

A shoe for the right foot will be illustrated (exemplified) in the following description.

The shoe shown in FIG. 1 is a shoe for a sport or for running, for example, and an upper 3 is secured on a sole 8. The upper 3 includes a flexible member 30, first and second reinforcement portions 1 and 2, and a shoelace (fastening member) which is not shown. Note that for the description of the embodiments of the present invention, the shoelace is not shown in the figures for ease of understanding of the figures.

The sole 8 is placed under the upper 3, and comes into contact with the road surface. The flexible member 30 may cover the medial side surface and the lateral side surface of the forefoot section as well as the toes and the heel, and may include a tongue 39 anterior F to a mouth (top line) 7. The reinforcement portions 1 and 2 and the shoelace are for fitting the flexible member 30 to the instep. The forefoot section includes five metatarsal bones and fourteen phalanges. The middle foot section includes a navicular bone, a cuboid bone, and three cuneiform bones. The rear foot section includes a talus (ankle) bone and a calcaneal bone.

The sole 8 may include an outsole 83 made of a rubber, and a midsole 80 on the outsole 83, the midsole 80 including a foamed resin such as EVA. The outsole 83 may be divided into a front and a rear portion. Note that a reinforcement unit 89 well known in the art for reinforcing the midsole 80 may be provided in the arch section, the reinforcement unit 89 being attached on the lower surface of the midsole 80.

In FIG. 1, FIG. 4, FIG. 5, FIG. 7 to FIG. 10 and FIG. 13C, the areas of the first and second reinforcement portions 1 and 2 are hatched.

The first and second reinforcement portions 1 and 2 may be formed by a natural material such as a resin material or a cotton thread. The resin material may be a material including a thermoplastic resin component and any other suitable component. Examples of the thermoplastic resin component may include a thermoplastic elastomer and a thermoplastic resin.

Figure 4:
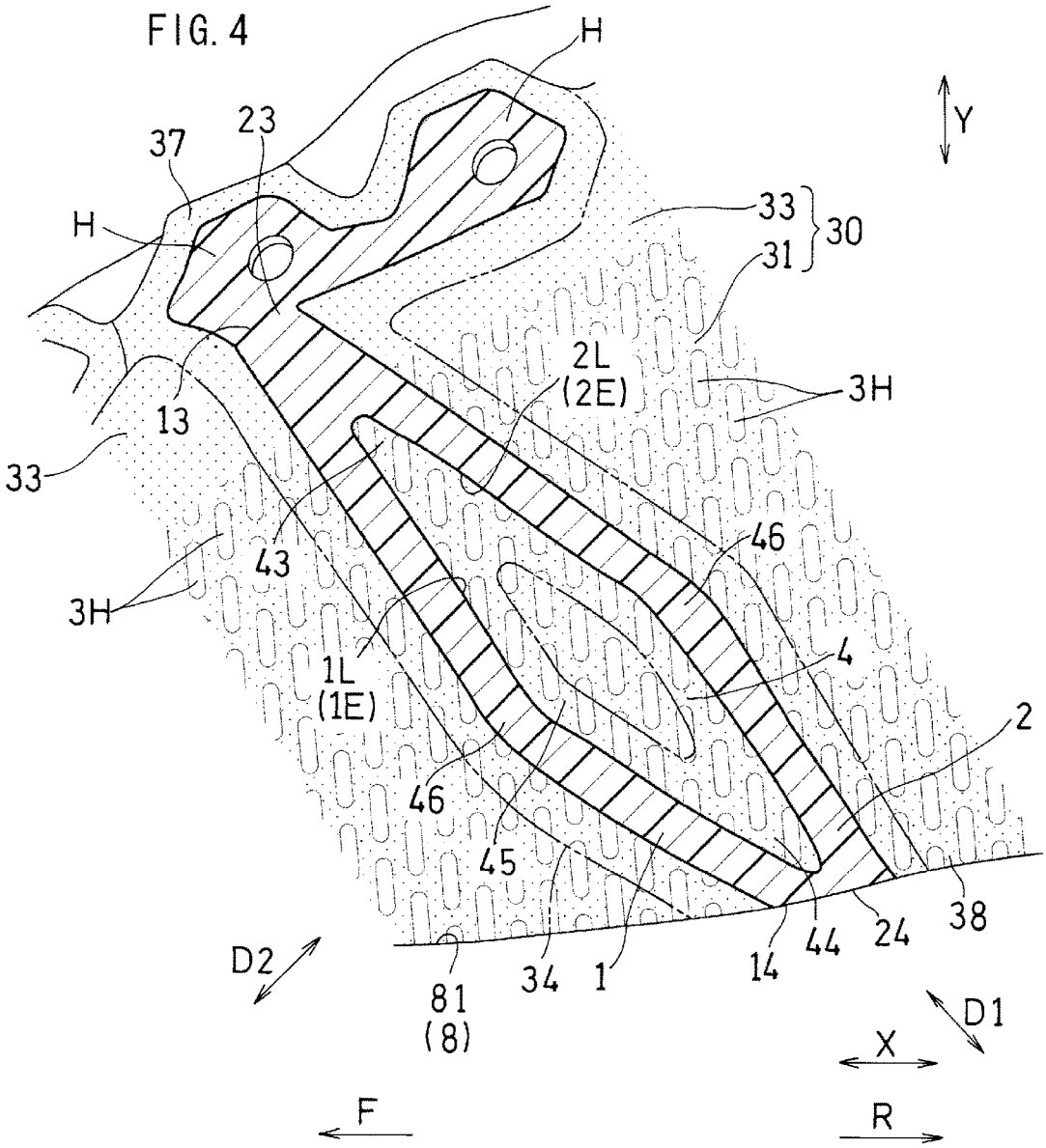
FIG. 4 is an enlarged medial side view showing the reinforcement portions, the flexible member, etc.
Figure 5:
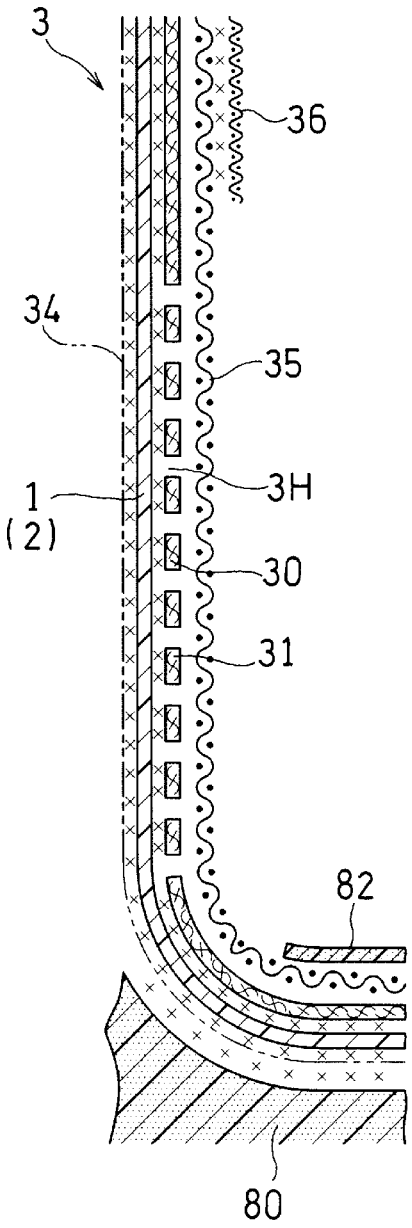
FIG. 5 is a cross-sectional view conceptually showing a medial side portion of the upper.

In FIG. 1, FIG. 4 and FIG. 5, areas of the flexible member 30 are provided with various geometric patterns. In FIG. 1, non-patterned areas of the upper 3 may be formed by a material of a greater stiffness than the flexible member 30.

The flexible member 30 of FIG. 1 includes a meshed first flexible portion 31 covering the medial side surface of the first metatarsal bone B1 (FIG. 3), a meshed second flexible portion 32 covering the upper surface of the toes, and a third flexible portion 33 arranged around these flexible portions, wherein the flexible portion are formed from a single sheet of fabric. In FIG. 1, the first flexible portion 31 is provided with a pattern of a large number of oblong circles, the second flexible portion 32 is provided with a lattice pattern, and the third flexible portion 33 are provided with a pattern of minute dots.

The meshed flexible portions 31 and 32 of FIG. 1 and FIG. 4 may be formed by a woven fabric or a knit fabric, for example, or may be formed by a meshed member well known in the art as an upper member. The first flexible portion 31 defines a large number of oblong slit-shaped through holes 3H arranged in a plurality of rows and a plurality of columns. Each through hole 3H may be elongated in the up-down direction Y as in the illustrated example, or may be elongated in a forward diagonal direction.

The first and second reinforcement portions 1 and 2 are attached (adhered) to a surface 3F of the flexible member 30. The term "attached" may be replaced by the word "secured (fixed)", and it conceptually means that objects are joined together in such a manner that they cannot be removed easily. Specifically, "attached" means that objects are joined together by means of bonding, welding, printing or sewing, or by a combination of two or more of these means.

In FIG. 1, the second flexible portion 32 is formed from a fabric having a large lattice pattern, and the second flexible portion 32, of the flexible member 30, has the smallest stiffness and is deformed most easily. As shown in FIG. 4 on an enlarged scale, the first flexible portion 31 includes a large number of oblong circular through holes 3H, and has an intermediate stiffness between the second flexible portion 32 and the third flexible portion 33.

The first and second reinforcement portions 1 and 2 stretch less easily than the first flexible portion 31 of the flexible member 30. The first and second reinforcement portions 1 and 2 may stretch more easily than the third flexible portion 33 of the flexible member 30. This is because the third flexible portion 33 of the flexible member 30 is placed in areas where the stretch should be suppressed, e.g., around the engagement portion H, and the flexible member 30 in itself has a high tensile stiffness (tensile rigidity).

That is, "the first and second reinforcement portions 1 and 2 stretching less easily than the flexible member 30", as used herein, means that the first and second reinforcement portions 1 and 2 stretch less easily than the flexible member 30 in more than half of the flexible member 30 with the first and second reinforcement portions 1 and 2 attached thereto; and as the first flexible portion 31 has an anisotropy as will be described later, it means that the tensile stiffness per predetermined width of the first and second reinforcement portions 1 and 2 is higher than the tensile stiffness per predetermined width of the first flexible portion 31 in the direction in which it stretches most easily.

A cross-sectional structure of the upper 3 with the first and second reinforcement portions 1 and 2 attached thereto will be described with reference to FIG. 5. As in the illustrated example, the upper includes the flexible member 30, the reinforcement portion 1 (2), a resin film 34, an interior member 35 and a backer member (backing member) 36, which are layered together. Note that in FIG. 5, "xx" denotes a bonded or welded area.

The interior member 35 and the backer member 36 are placed on the reverse side of the flexible member 30, and these members 30, 35 and 36 are sewn together along the perimeter. Note that the backer member 36 is placed in a band-shaped pattern extending in the front-rear direction on the reverse side of an upper edge 37 of the medial side portion of the upper of FIG. 1, and reinforces the engagement portions (e.g., eyelet portions) H along the upper edge 37.

In FIG. 5, the first flexible portion 31 of the flexible member 30 can stretch/shrink without being essentially restrained by the interior member 35. That is, if a tension acts in the up-down direction Y of the first flexible portion 31 of FIG. 4, the large number of oblong circular through holes 3H are slightly stretched in the up-down direction Y to deform thinner. On the other hand, if a tension acts in the front-rear direction X of the first flexible portion 31, the large number of oblong circular through holes 3H are stretched substantially to expand into an elliptical shape.

That is, the first flexible portion 31 of the flexible member 30 has such an anisotropy that it stretches more easily in the front-rear direction X than in the up-down direction Y.

The first reinforcement portion 1 (2) and the film 34 may be attached on the outer surface side of the flexible member 30 of FIG. 5. The film 34 is denoted by a two-dot-chain line in the figures, and the film 34 extends over a broader area than the reinforcement portions 1 and 2, as is clearly shown in FIG. 4, and is welded to the reinforcement portions 1 and 2 and the flexible member 30. This assists in preventing the thin reinforcement portions 1 and 2 from coming off (peeling off) of the flexible member 30.

Part of the resin structure of the reinforcement portions 1 and 2 or the film 34 welded or printed on the flexible member 30 of FIG. 5 will get into (enter, or penetrate) minute depressions or gaps in the fibers of the flexible member 30. Therefore, the flexible member 30 becomes integral with the reinforcement portions 1 and 2, which will likely increase the stiffness of the reinforcement portions 1 and 2.

The flexible member 30, the film 34 and the interior member 35 are sandwiched between the midsole 80 and an insole 82, as with an ordinary upper. This secures the upper 3 and the midsole 80 with each other.

In FIG. 1 and FIG. 4, the first reinforcement portion 1 extends in a band-shaped pattern from the boundary portion 38 between the upper 3 and the sole 8 toward the upper edge 37 obliquely forward and upward. The second reinforcement portion 2 is placed posterior R to the first reinforcement portion 1, and extends in a band-shaped pattern from the boundary portion 38 between the upper 3 and the sole 8 toward the upper edge 37 obliquely forward and upward.

In the illustrated example, the engagement portion H is continuous with the upper ends 13 and 23 of the first and second reinforcement portions 1 and 2.

In the illustrated example, the upper end 13 of the first reinforcement portion 1 and the upper end 23 of the second reinforcement portion partially overlap each other, and are continuous with each other in the front-rear direction X. The lower end 14 of the first reinforcement portion 1 and the lower end 24 of the second reinforcement portion 2 partially overlap each other, and are continuous with each other in the front-rear direction X.

As shown in FIG. 4, the flexible member 30 includes the reinforced area 4 reinforced by the first and second reinforcement portions 1 and 2.

The area 4 is defined by the first envelope line 1L along the posterior edge 1E of the first reinforcement portion 1 and the second envelope line 2L along the anterior edge 2E of the second reinforcement portion 2. In the illustrated example, the first and second reinforcement portions 1 and 2 are smoothly continuous with each other without gaps, and the posterior edge 1E of the first reinforcement portion 1 and the anterior edge 2E of the second reinforcement portion 2 respectively coincide with the first envelope line 1L and the second envelope line 2L. In the illustrated example, the perimeter of the area 4 is completely surrounded by the first and second reinforcement portions 1 and 2.

The area 4 includes the upper end portion 43, the lower end portion 44, and the intermediate portion 45 between the upper end portion 43 and the lower end portion 44. The upper end portion 43 of the area 4 is placed anterior F to the lower end portion 44. That is, the area 4 extends in a forward-upward diagonal direction from the lower end portion 44 to the upper end portion 43.

Figure 2:
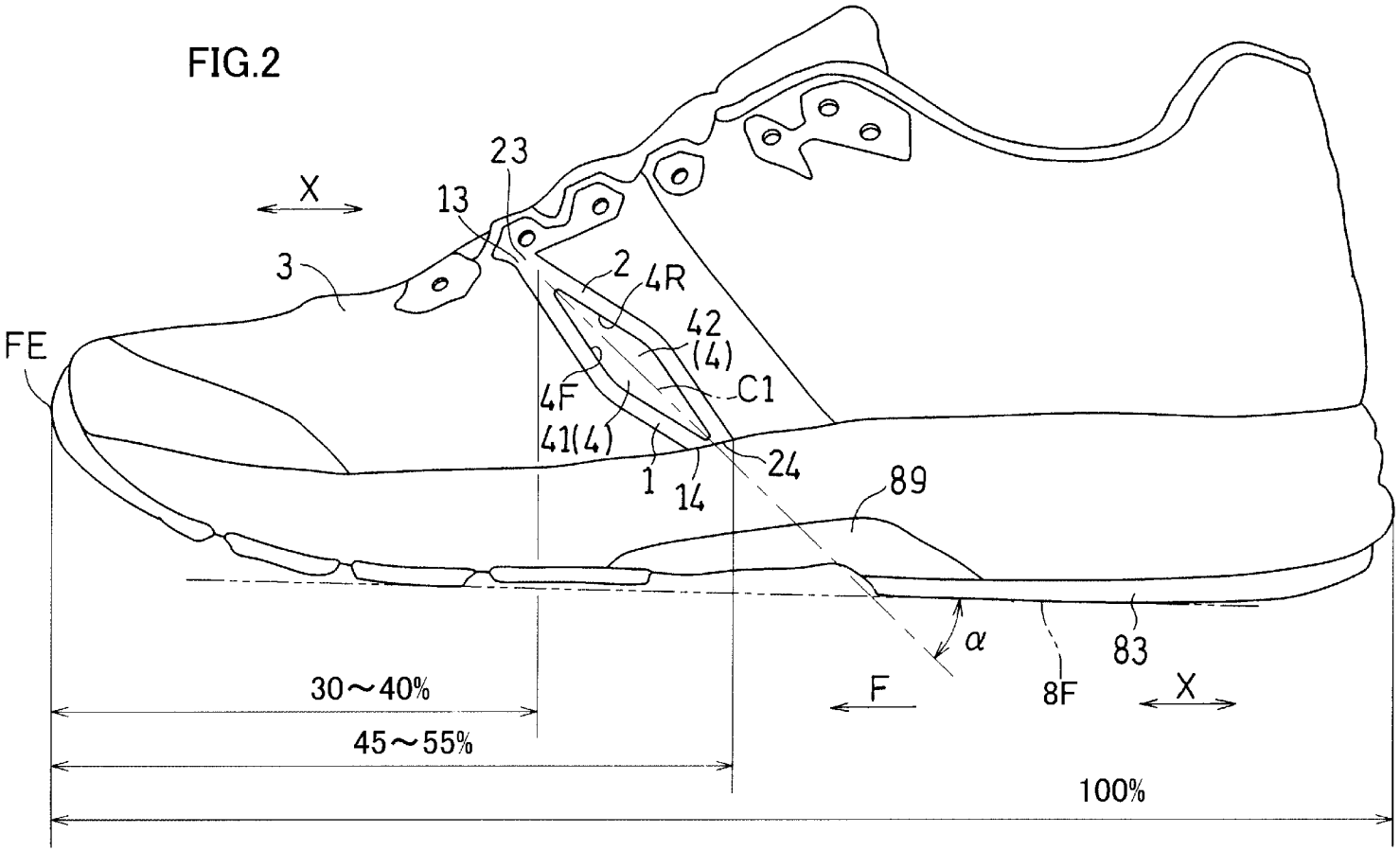
FIG. 2 is a schematic medial side view thereof.

As shown in FIG. 2, the virtual first center line C1 generally equally divides the area 4 into a first portion 41 of which the anterior edge 4F is defined by the first envelope line 1L (FIG. 4) and a second portion 42 of which the posterior edge 4R is defined by the second envelope line 2L (FIG. 4). The virtual first center line C1 extends obliquely forward and upward. The angle α formed between the first center line C1 and the tread surface 8F of the sole 8 is set to about 40° to 55° in the illustrated example.

Note that the first center line C1 may be arranged in the illustrated example so that an extension line of the first center line C1 crosses the reinforcement unit 89 and the arch section, as seen in a side view.

Figure 6:
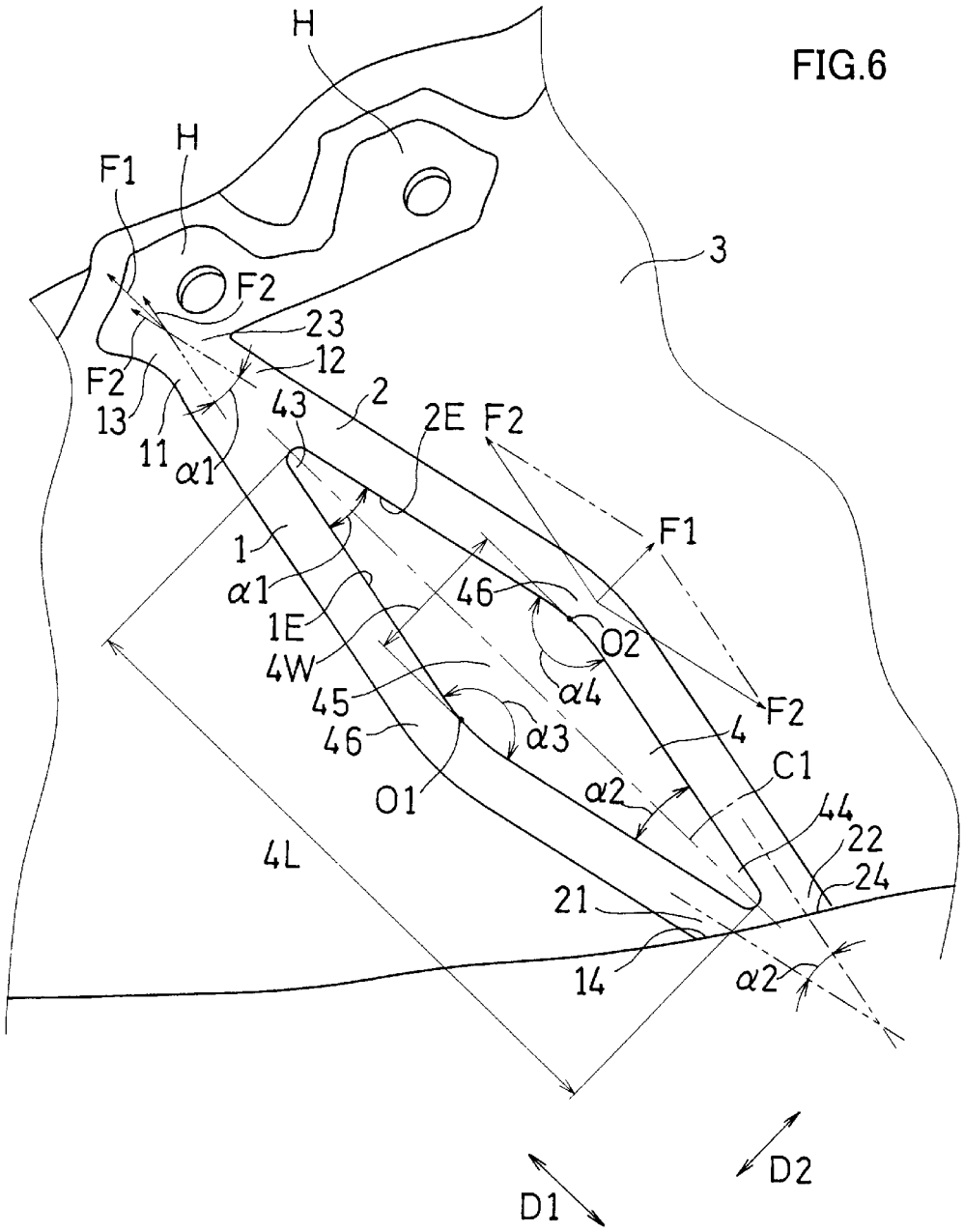
FIG. 6 is a medial side view showing, on an enlarged scale, a portion of the upper including the reinforcement portions.

In FIG. 6, the width 4W of the area 4 in the direction D2 perpendicular to the direction D1 along which the first center line C1 extends is at maximum in the intermediate portion 45. The width 4W of the area gradually decreases toward the upper end portion 43 from the intermediate portion 45. The width 4W of the area gradually decreases toward the lower end portion 44 from the intermediate portion 45. Note that in the illustrated example, the area 4 is generally diamond-shaped. The two reinforcement portions 1 and 2 form a frame (casing) shape surrounding the diamond shape.

Figure 7:
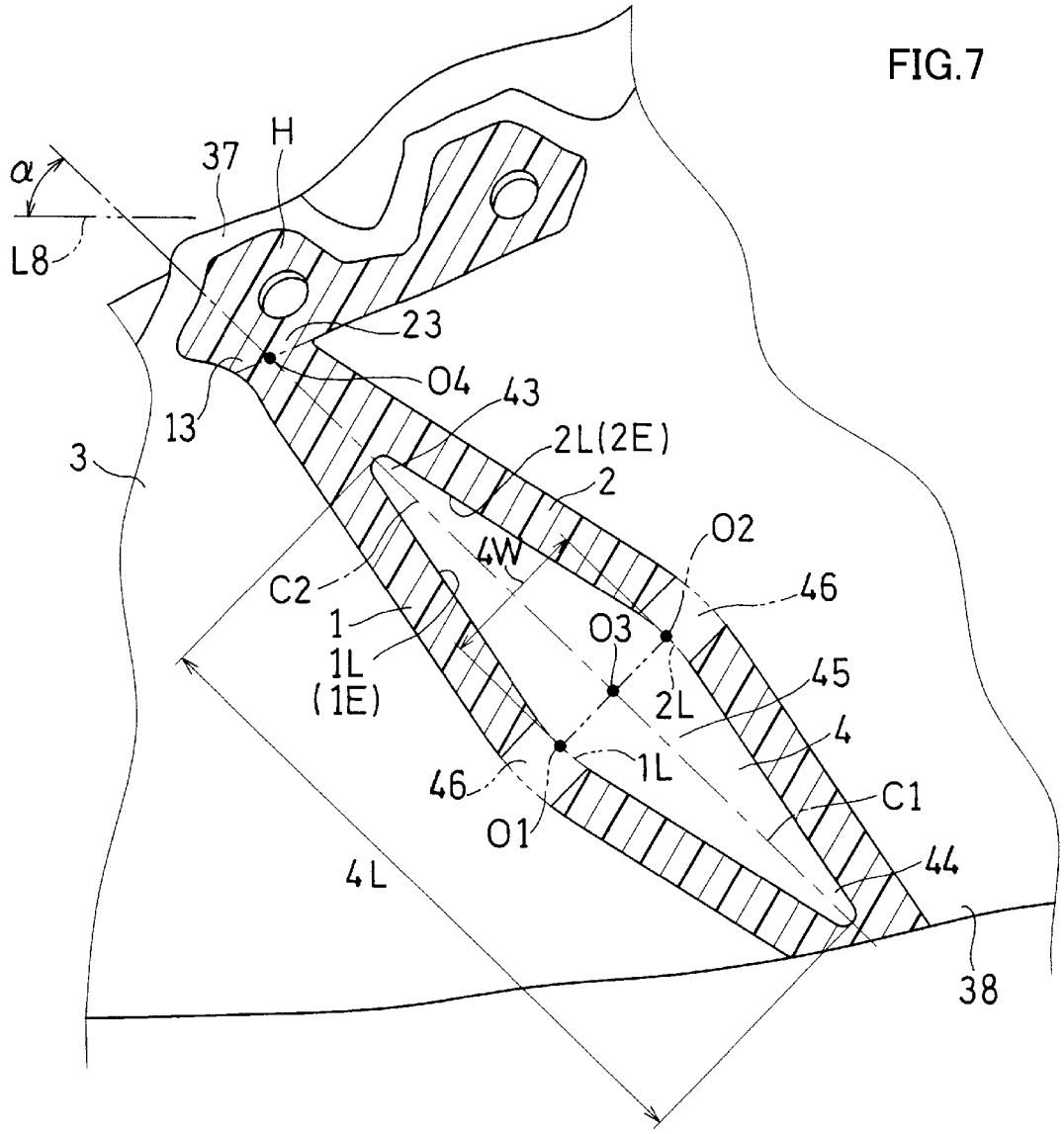
FIG. 7 is a medial view showing a portion of an upper including reinforcement portions according to Embodiment 2.
Figure 8A:
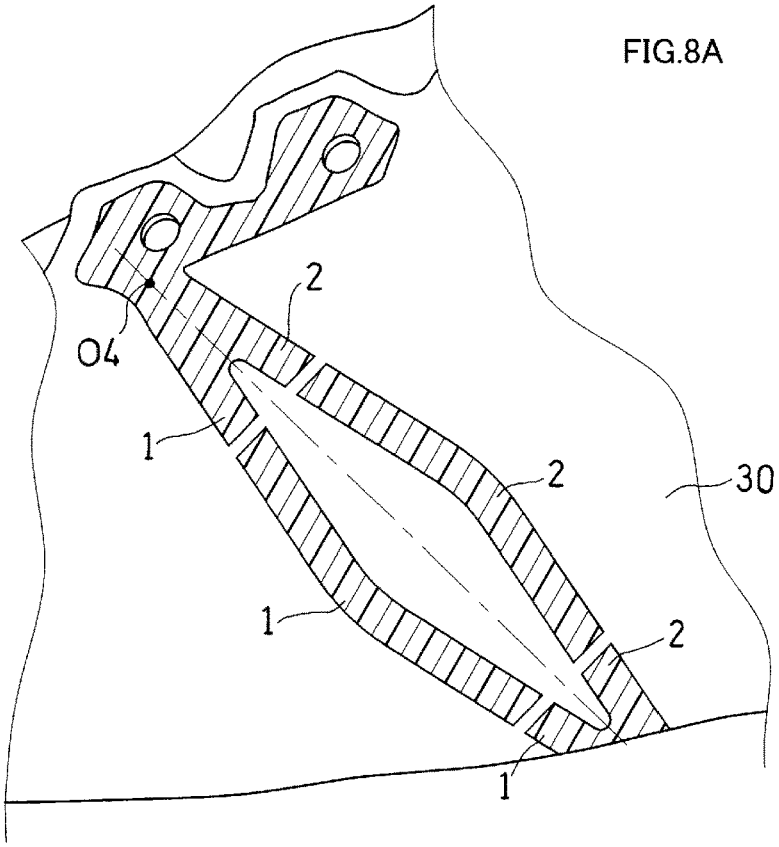
FIG. 8A and FIG. 8B are medial side views showing a portion of an upper including reinforcement portions according to Embodiments 3 and 4, respectively.
Figure 8B:
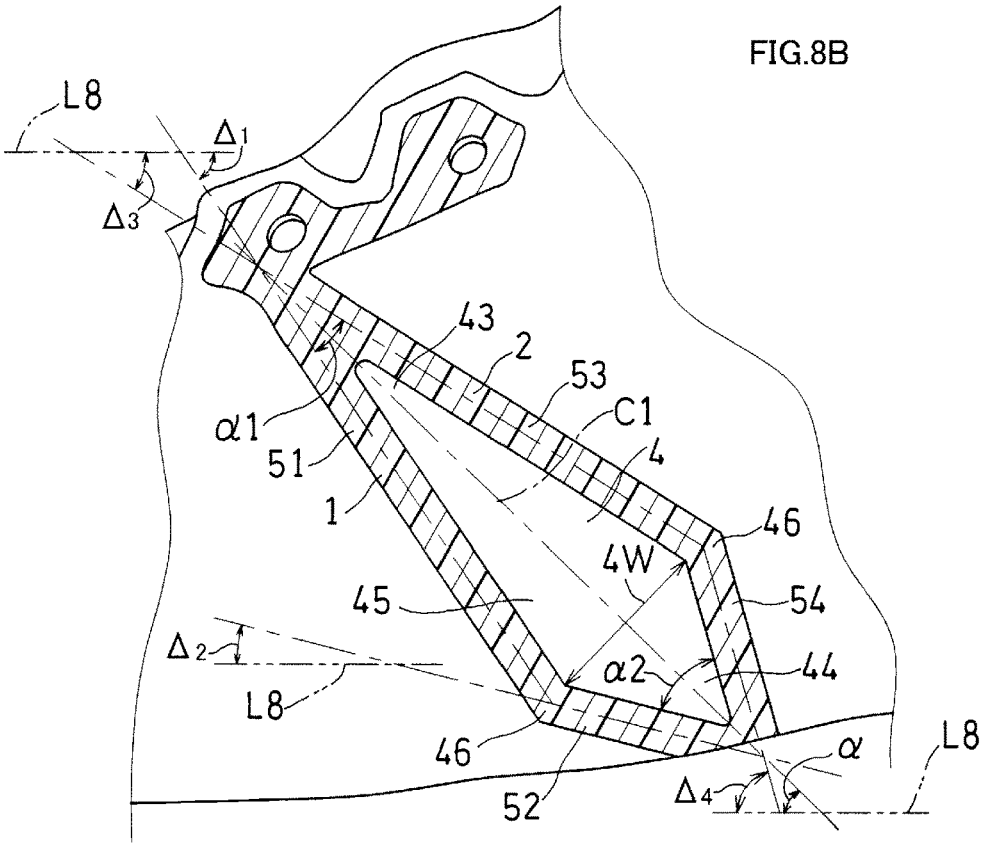
Figure 9A:
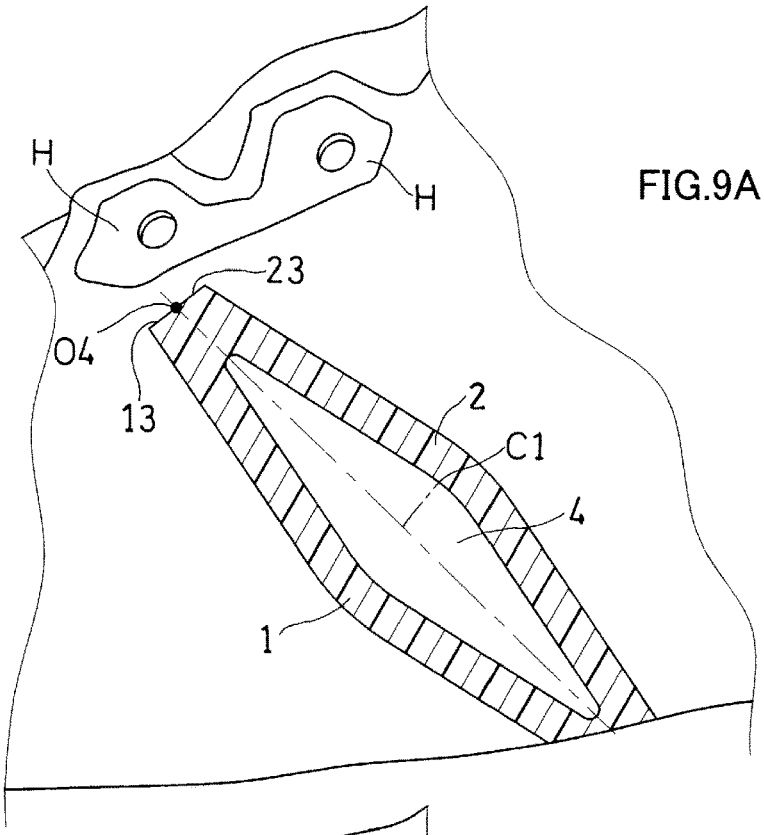
FIG. 9A and FIG. 9B are medial side views showing a portion of an upper including reinforcement portions according to Embodiments 5 and 6, respectively.
Figure 9B:
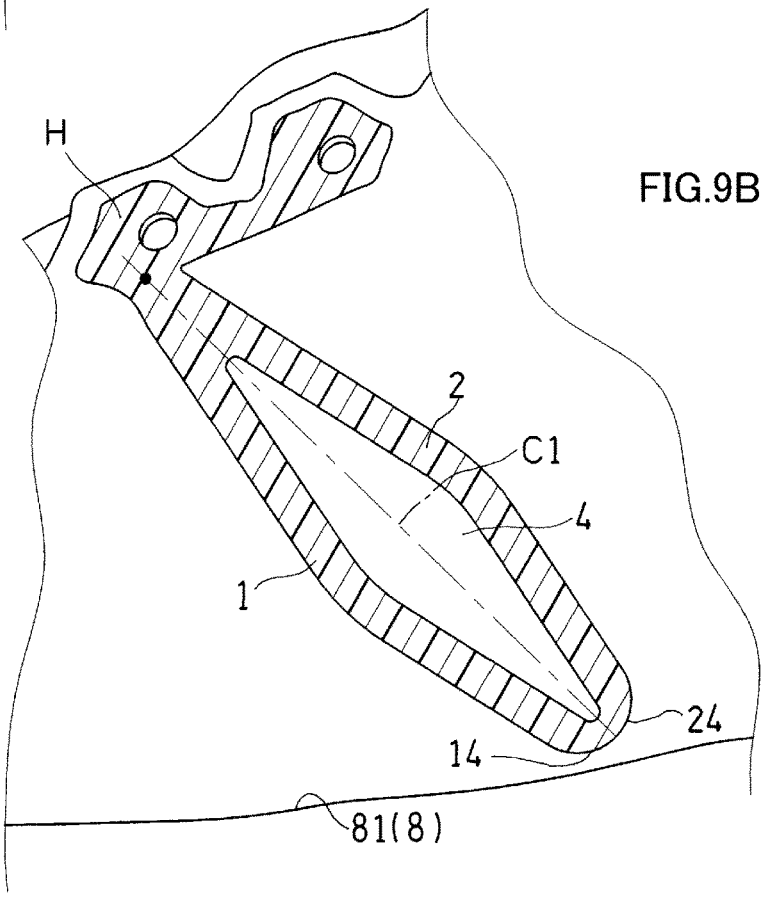
Figure 10:
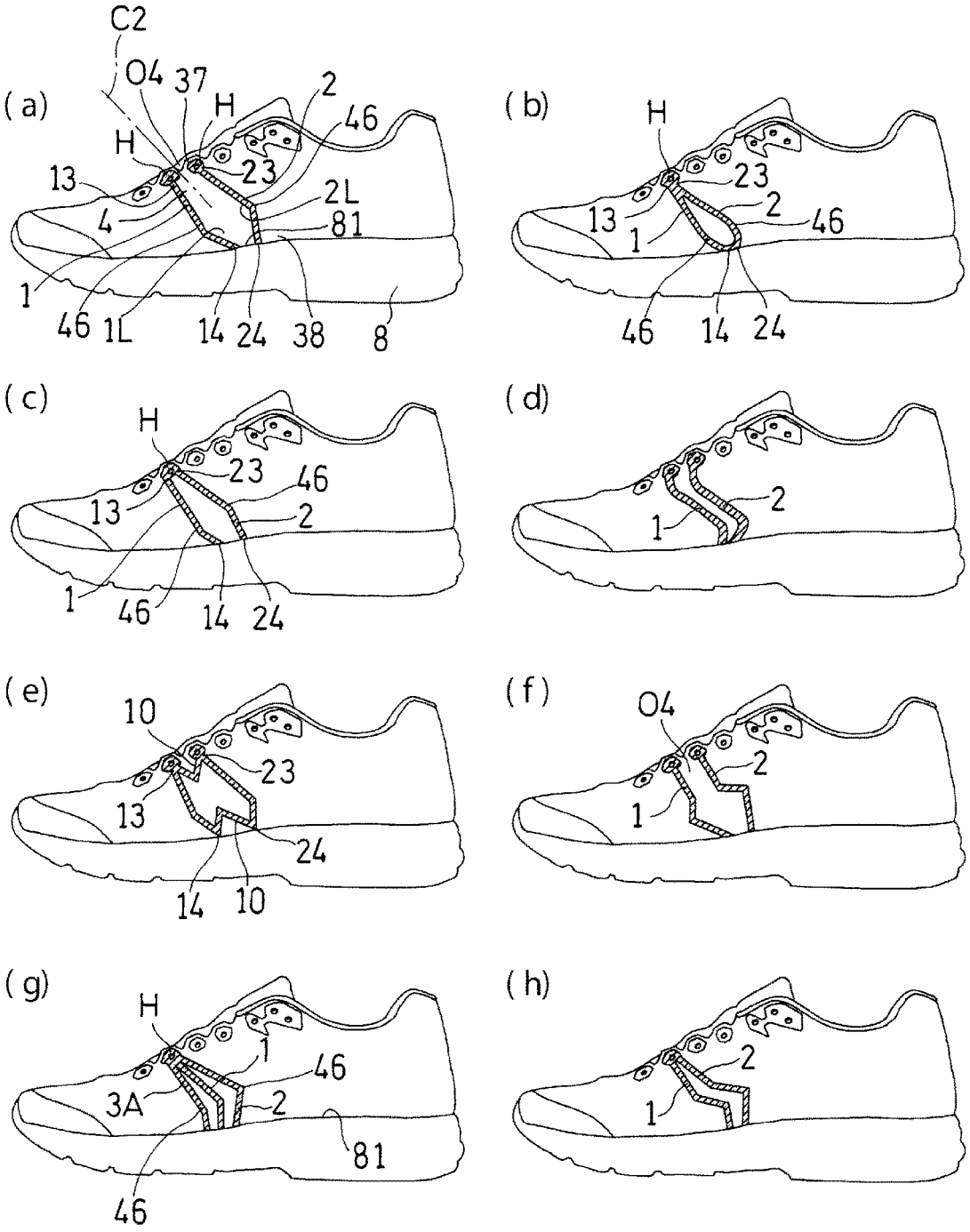
FIG. 10 is a schematic medial side view of a shoe showing alternative embodiments of the reinforcement portions.
Figure 11A:
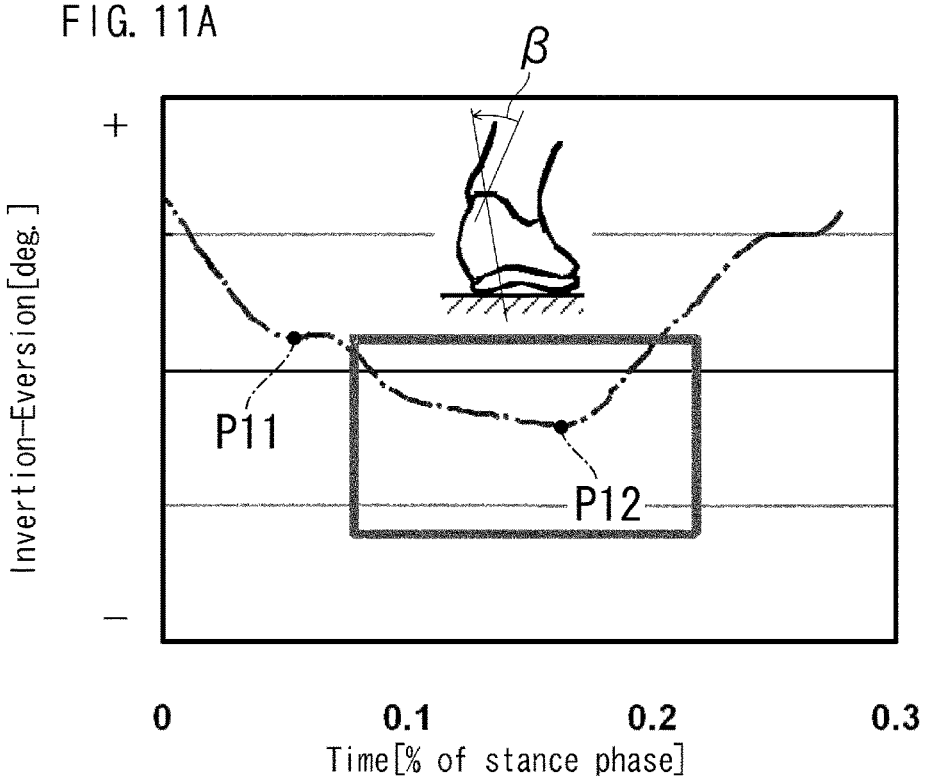
FIG. 11A is a graph showing the change in the eversion angle β of the heel portion.
Figure 11B:
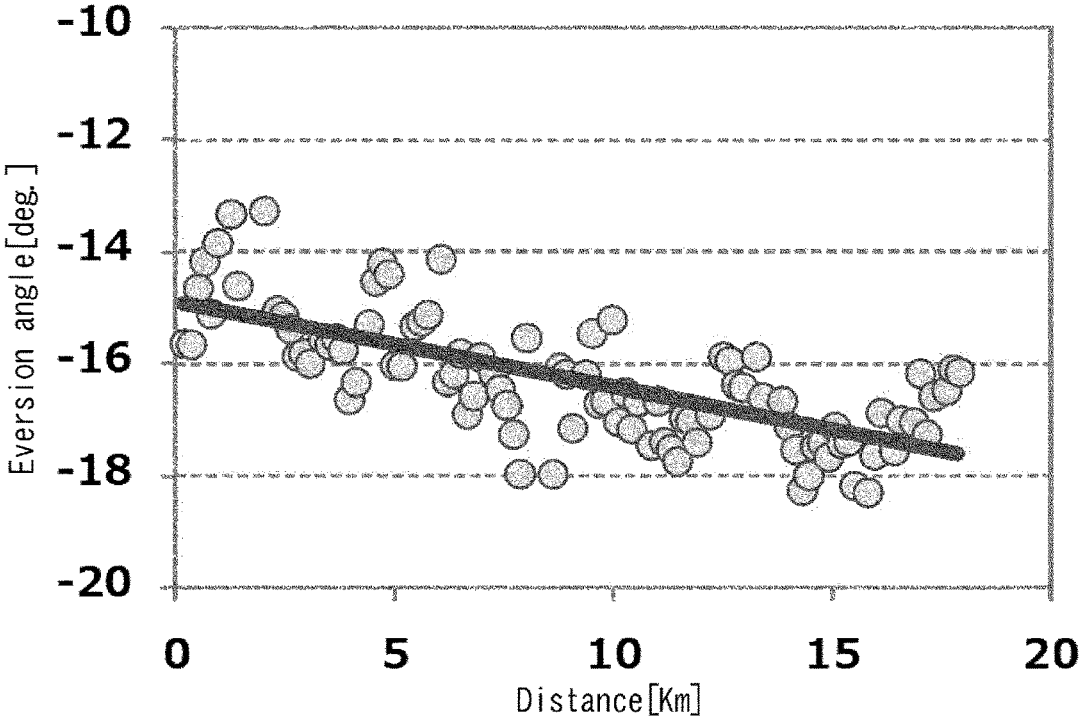
FIG. 11B is a graph showing the relationship between the second peak value of the eversion angle β and the running distance.

The frame shape of the reinforcement portions 1 and 2 does not always need to be diamond-shaped as shown in FIG. 6, but may be rectangular as shown in FIG. 8B or a non-rectangular as shown in FIG. 10(*b*). Herein, the "frame shape" includes cases where the reinforcement portions 1 and 2 form a complete loop surrounding the area 4, as shown in FIG. 10(*b*), FIG. 8B to FIG. 9B and FIG. 6, and cases where the reinforcement portions 1 and 2 surround the area 4 and are continuous, but the loop is incomplete, as shown in FIG. 7 or FIG. 8A.

In FIG. 6, the length 4L of the area 4 in the direction D1 along which the virtual first center line C1 extends is greater than the maximum value of the width 4W of the area 4.

In the case of this example, the angle α1 formed between the first reinforcement portion 1 and the second reinforcement portion 2 at the upper ends 13 and 23 of the first and second reinforcement portions is an acute angle. The angle α2 formed between the first reinforcement portion 1 and the second reinforcement portion 2 at the lower ends 14 and 24 of the first and second reinforcement portions is an acute angle. These angles α1 and α2 may be determined by the angle formed between the center lines (denoted by a two-dot-chain line) of the reinforcement portions 1 and 2, or by the angle formed between two straight lines respectively forming the posterior edge 1E and the anterior edge 2E.

The angle α3 formed by the first reinforcement portion 1 at the first bend point O1 of the first envelope line 1L is an obtuse angle. The angle α4 formed by the second reinforcement portion 2 at the second bend point O2 of the second envelope line 2L is an obtuse angle. Where a bend portion 46 is curved smoothly as in the example of FIG. 6, the angles α3 and α4 may be determined by the angle formed between the two straight lines respectively forming the posterior edge 1E of the reinforcement portion 1 and the anterior edge 2E of the reinforcement portion 2, or the angle formed between the center lines of the reinforcement portions 1 and 2 as described above.

In this example, if an external force F1 acts on the first end portions 11 and 12 in upper of the reinforcement portions 1 and 2 or the second end portions 21 and 22 in lower of the reinforcement portions 1 and 2, each component force F2 thereof is relatively small. On the other hand, if an external force F1 acts on the bend portion 46 in the middle of each of the reinforcement portions 1 and 2, each component force F2 thereof is relatively large. Therefore, the reinforcement portions 1 and 2 has such an anisotropy that they stretch less easily in the direction D1 along the first center line C1 while stretching more easily in the direction D2 perpendicular to the direction D1.

In FIG. 2, with 100% being the entire length of the shoe, the lower ends 14 and 24 of the reinforcement portions may be placed within the range of 45% to 55% of the entire length (100%), as measured from the front end FE of the shoe in the front-rear direction X. On the other hand, the upper ends 13 and 23 of the first and second reinforcement portions are placed within the range of 30% to 40% of the entire length (100%), as measured from the front end FE. The upper end 13 of the first reinforcement portion is placed anterior to the lower end 14 of the first reinforcement portion. The upper end 23 of the second reinforcement portion is placed anterior to the lower end 24 of the second reinforcement portion.

Figure 3:
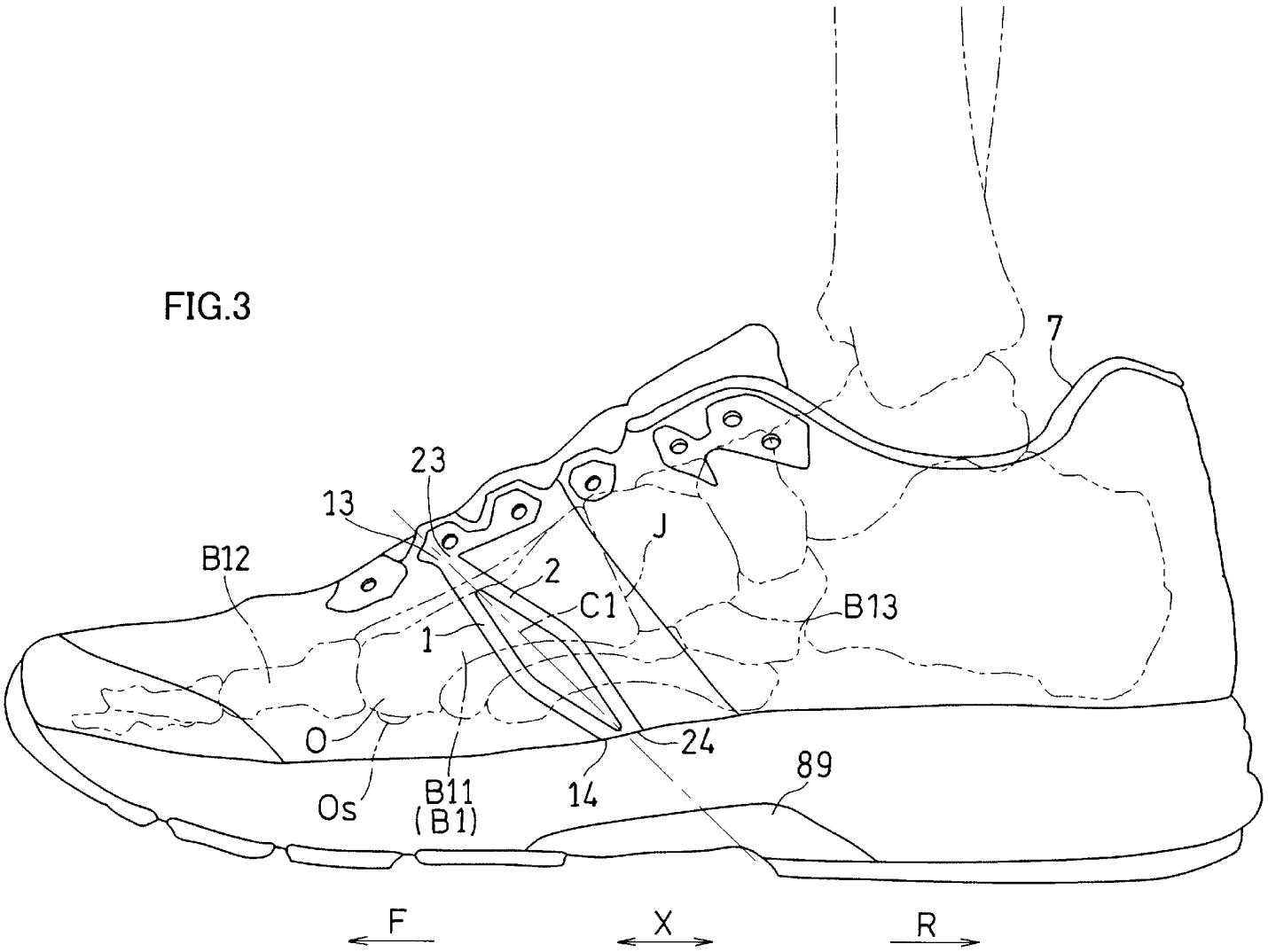
FIG. 3 is a medial side view thereof, showing the relationship between the foot bone structure and the shoe.

In FIG. 3, the respective lower ends 14 and 24 of the first and second reinforcement portions are adapted to the position of the arch on the medial side of the foot. The upper end 13 of the first reinforcement portion is adapted to the position of the ball O of the big toe or posterior to the ball O of the big toe, and is more specifically placed posterior to the sesamoid bone Os. The upper end 13 is placed anterior to the Lisfranc joint J.

The first and second reinforcement portions 1 and 2 are placed so that the virtual first center line C1 crosses the shaft B11 of the first metatarsal bone B1, as seen in a side view. Moreover, as in the illustrated example, the first and second reinforcement portions 1 and 2 may be placed so as to cross the first metatarsal bone B1, and more preferably so as to extend in a forward-upward diagonal direction to cover at least a portion of the shaft B11 of the first metatarsal bone B1 and so as not to cross the first proximal phalanx B12 anterior to the first metatarsal bone B1 or the medial cuneiform bone B13 posterior to the first metatarsal bone B1, as seen in a side view.

Now, the shaft refers to a portion between the base and the head, and the thickness thereof typically changes smoothly. The base refers to a portion of each bone that is close to a joint posterior thereto and that is slightly expanding to a greater thickness, and it is referred to also as the proximal head. On the other hand, the head refers to a portion of each bone that is close to a joint anterior thereto and that is slightly expanding to a greater thickness, and it is referred to also as the distal head. Note that the sesamoid bone Os generally refers to a bone piece produced inside a tendon running through a joint area, or the like, while being in contact with a bone.

FIG. 7 shows the first and second reinforcement portions 1 and 2 of Embodiment 2. This example shows a case where each of the first and second reinforcement portions 1 and 2 is split or broken into two (a plurality of) pieces, and is discontinuous at the intermediate bend portion 46 (FIG. 6).

The first envelope line 1L along the posterior edge 1E of the first reinforcement portion includes the first bend point O1 at which the first envelope line 1L bends, the first bend point O1 located above the boundary portion 38 and below the upper edge 37 of the upper 3. The second envelope line 2L along the anterior edge 2E of the second reinforcement portion includes the second bend point O2 at which the second envelope line 2L bends, the second bend point O2 located above the boundary portion 38 and below the upper edge 37 of the upper 3. Now, the bend point O1 (O2) forms an inflection point of one envelope line 1L (2L) in the intermediate portion 45 of the area 4.

The first reinforcement portion 1 and the second reinforcement portion 2 come gradually closer to each other as the first envelope line 1L and the second envelope line 2L extend upward respectively from the first and second bend points O1 and O2. The first reinforcement portion 1 and the second reinforcement portion 2 come gradually closer to each other as the first envelope line 1L and the second envelope line 2L extend downward respectively from the first and second bend points O1 and O2.

In the case of the example of FIG. 6, the first reinforcement portion 1 and the second reinforcement portion 2 come gradually closer to each other as the first reinforcement portion 1 and the second reinforcement portion 2 extend upward from the respective bend portions 46. The first reinforcement portion 1 and the second reinforcement portion 2 come gradually closer to each other as the first reinforcement portion 1 and the second reinforcement portion 2 extend downward from the respective bend portions 46.

In FIG. 7, the length 4L of the area 4 in the longitudinal direction perpendicular to the direction extending from the first bend point O1 toward the second bend point O2 is greater than the width 4W of the area 4 between the first bend point O1 and the second bend point O2.

In FIG. 7, the virtual second center line C2 extends from the midpoint O3 of the virtual line segment (denoted by a two-dot-chain line) connecting between the first bend point O1 and the second bend point O2 to the point O4 included in the upper ends 13 and 23 of the first and second reinforcement portions 1 and 2. The angle $\alpha$ formed between the virtual second center line C2 and the tread surface 8F of the sole 8 may be set to about 40° to 55°. Where the upper ends 13 and 23 are spaced apart from each other in the front-rear direction as shown in FIG. 10(*a*), the virtual second center line C2 extends to the point O4 between the upper ends 13 and 23.

As shown in FIG. 8A, the reinforcement portions 1 and 2 may each be split or broken into three or more pieces. At each splitting position, the flexible member 30 is allowed to stretch/shrink in the direction along which the reinforcement portions 1 and 2 extend, without being so much restrained by the reinforcement portions 1 and 2.

Although the upper ends 13 and 23 of the first and second reinforcement portions 1 and 2 are continuous with the engagement portions H, with which the shoelace engages, in the example of FIG. 4, they may be adjacent to the engagement portions H as shown in FIG. 9A. Where the upper ends 13 and 23 are continuous with the engagement portion H, the upper ends 13 and 23 may be located between the upper end of the area 4 and the lower end of the eyelet hole.

In the example of FIG. 4, the respective lower ends 14 and 24 of the first and second reinforcement portions 1 and 2 are continuous with the upper surface 81 of the sole 8, but they may be adjacent to the upper surface 81 of the sole as shown in FIG. 9B.

FIG. 8B shows the first and second reinforcement portions 1 and 2 of another example.

The first and second reinforcement portions 1 and 2 may be shaped with angular bend portions 46 as shown in FIG. 8B.

Figure 12A:
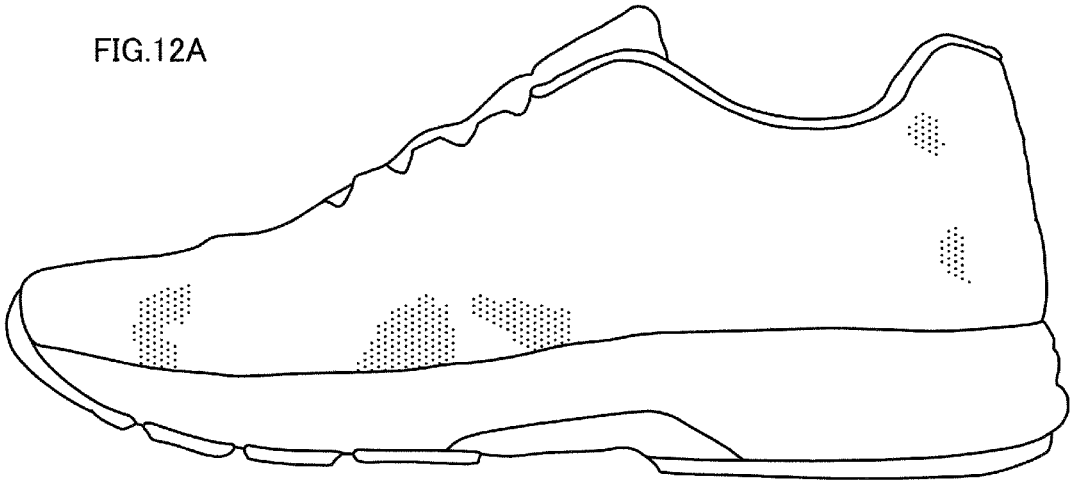
FIG. 12A and FIG. 12B are schematic medial side views of a shoe, each showing how the upper is deformed after running a predetermined distance.
Figure 12B:
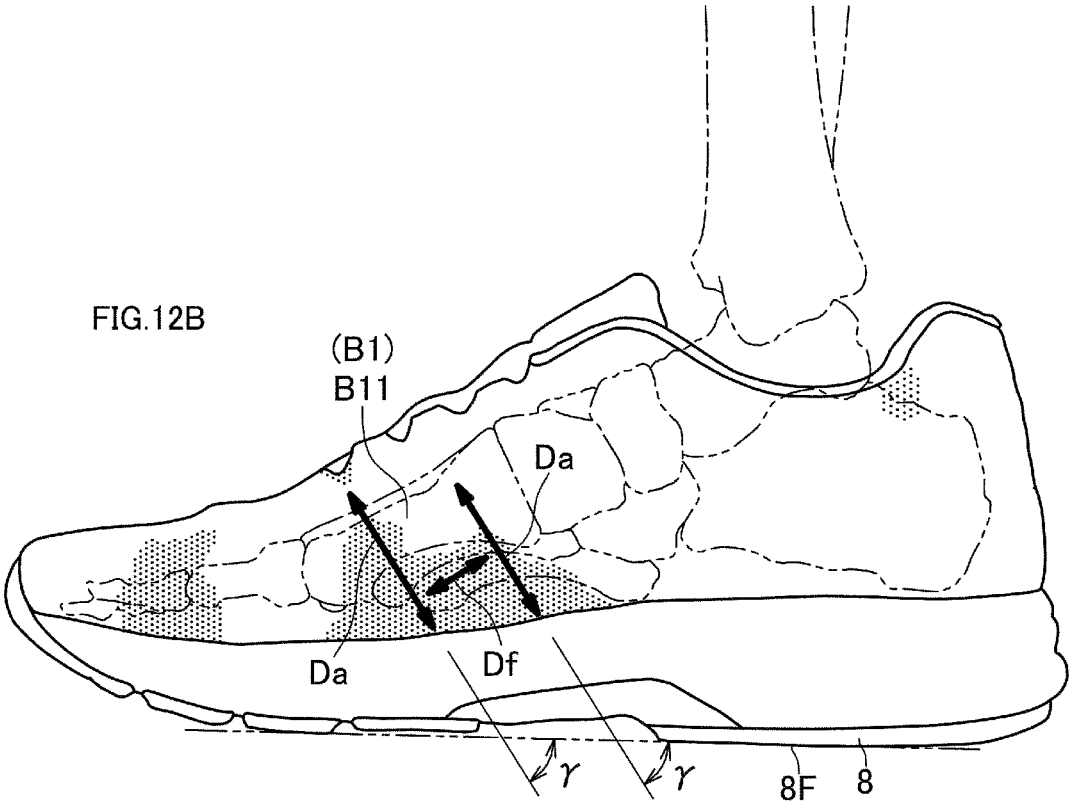

In FIG. 8B, the angle $\alpha$2 is greater than the angle $\alpha$1. Therefore, the position at which the width 4W of the area 4 is at maximum is arranged at the intermediate portion 45, which is closer to the lower end portion 44 than to the upper end portion 43 of the area 4. With such an arrangement, the portion of the area 4 that easily deforms will more likely coincide with the area where strain is likely to occur as shown in FIG. 12B.

In view of this, the position at which the width 4W of the area 4 of FIG. 8B is at maximum is preferably arranged at or below the center of the area 4 extending in a forward-upward diagonal direction.

Note that the angle $\alpha$1 and the angle $\alpha$2 may be equal to each other as shown in FIG. 6.

As shown in FIG. 8B, the first reinforcement portion 1 includes a first upper portion 51 above the bend portion 46 and a first lower portion 52 below the bend portion 46, wherein the first upper portion 51 and the first lower portion 52 are continuous with each other at the bend portion 46. The second reinforcement portion 2 includes a second upper portion 53 above the bend portion 46 and a second lower portion 54 below the bend portion 46, wherein the second upper portion 53 and the second lower portion 54 are continuous with each other at the bend portion 46.

In FIG. 8B, angles $\Delta_1$ to $\Delta_4$ formed by the center lines of these portions 51 to 54 (denoted by one-dot-chain lines) with the tread surface 8F of the sole (FIG. 2) are represented by angles $\Delta$1 to $\Delta$4 formed by these center lines with a virtual horizontal line L8 that is parallel to the tread surface 8F (FIG. 2).

In the embodiment described above, the inclination of the reinforcement portions 1 and 2 is represented by the angle $\alpha$ formed by the reinforcement portions with the tread surface 8F (FIG. 2). The angle α, which is the inclination of the reinforcement portions 1 and 2, can be expressed as shown in Expression (1) below.

$$\alpha=(\Delta_1+\Delta_2+\Delta_3+\Delta 4)/4 \quad (1)$$

That is, the value of the angle α is the value obtained by dividing the sum of the angles $\Delta_1$ to $\Delta_4$ of n portions 51 to 54 by the number "n". The angle $\Delta_i$ may be $\Delta_i<90°$. That is, each of the angles $\Delta_1$ to $\Delta_4$ may be less than 90°. The angle $\Delta_i$ may also be $\Delta_i>10°$. That is, each of the angles $\Delta_1$ to $\Delta_4$ may be greater than 10°.

FIG. 10 shows still another example.

As shown in FIG. 10(*a*), the upper end 13 of the first reinforcement portion 1 and the upper end 23 of the second reinforcement portion 2 may be continuous respectively with different engagement portions H. In such a case, the upper end 13 of the first reinforcement portion and the upper end 23 of the second reinforcement portion are spaced apart from each other. The lower end 14 of the first reinforcement portion 1 and the lower end 24 of the second reinforcement portion 2 may be spaced apart from each other in the direction described above at the boundary portion 38.

In the illustrated example, the perimeter of the area 4 is surrounded by the first reinforcement portion 1, the second reinforcement portion 2, the upper surface 81 of the sole 8 and the upper edge 37 of the upper 3. That is, the area 4 is a portion that is sandwiched or surrounded by the envelope line 1L of the first reinforcement portion 1 and the envelope line 2L of the second reinforcement portion 2.

As shown in FIG. 10(*b*), the upper ends 13 and 23 of the first and second reinforcement portions 1 and 2 may be continuous with only one engagement portion H. On the other hand, the first and second reinforcement portions 1 and 2 may be continuous with each other in a smooth arc pattern at the lower ends 14 and 24 of the first and second reinforcement portions.

The bend portion 46 may be formed in a smooth arc pattern.

As shown in FIG. 10(*c*), the upper ends 13 and 23 of the two reinforcement portions may be continuous with one engagement portion H while the respective lower ends 14 and 24 of the two reinforcement portions are spaced apart from each other in the front-rear direction.

As shown in FIG. 10(*d*), the first and second reinforcement portions 1 and 2 may be bent in an S-shaped pattern. As shown in FIGS. 10(*d*), (*g*) and (*h*), the first reinforcement portion 1 may be bent in a similar pattern to the second reinforcement portion 2. In these cases, the shape of the first reinforcement portion 1 is similar to that of the second reinforcement portion 2.

In contrast, in the examples of FIG. 1 to FIG. 9B and those of FIG. 10(*a*) to (*c*), the shape of the first reinforcement portion 1 and that of the second reinforcement portion 2 are generally in line symmetry with respect to the first center line C1 of FIG. 6. In such a case, two interior angles α3 and α4 opposing each other at the bend portion 46 are both an obtuse angle greater than 90° and less than 180°.

The upper ends 13 and 23 of the two reinforcement portions of FIG. 10(*a*) may be connected together in a V-shaped pattern by a separate reinforcement portion 10 of FIG. 10(*e*). Similarly, the lower ends 14 and 24 of FIG. 10(*a*) may be connected together in a V-shaped pattern by a separate reinforcement portion 10 of FIG. 10(*e*).

As shown in FIG. 100, the first and second reinforcement portions 1 and 2 may extend parallel to each other over a part thereof.

As shown in FIG. 10(*g*), a third reinforcement portion 3A may be provided in addition to the first and second reinforcement portions 1 and 2. Also in such a case, the first to third reinforcement portions 1, 2 and 3A do not each extend along a single straight line from the vicinity of an engagement portion H to the upper surface 81 of the sole, but includes a bend portion 46 at which it bends.

Although the first and second reinforcement portions 1 and 2 are covered by the transparent film 34 in the example of FIG. 4, such a film 34 is not always necessary. The first and second reinforcement portions 1 and 2 may be attached to the flexible member 30 by means of an adhesive and a sewing thread.

Where the first and second reinforcement portions 1 and 2 are formed by a cotton thread or a nylon thread, which do not stretch easily, for example, a film or a cloth having a similar shape to the first and second reinforcement portions 1 and 2 and having a smaller stiffness than the first flexible portion 31 may be sewn to the surface of the flexible member 30 by means of the thread.

Next, the stiffness characteristic of the virtual area VA including the flexible member 30 and the reinforcement portions will be described with reference to FIG. 13B and FIG. 13C.

Figure 13A:
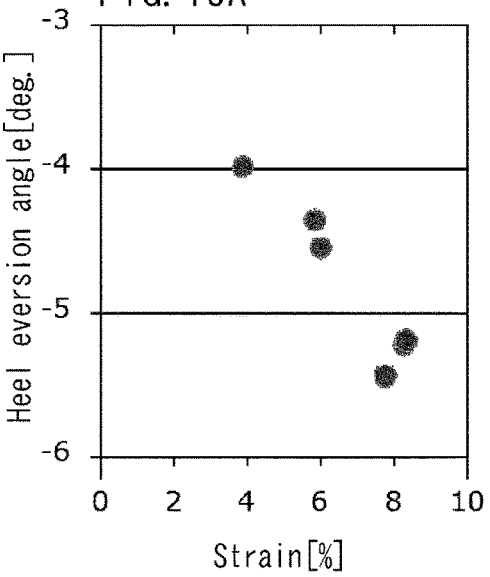
FIG. 13A is a graph showing the correlation between the stretch of the upper and the eversion angle β.
Figure 13B:
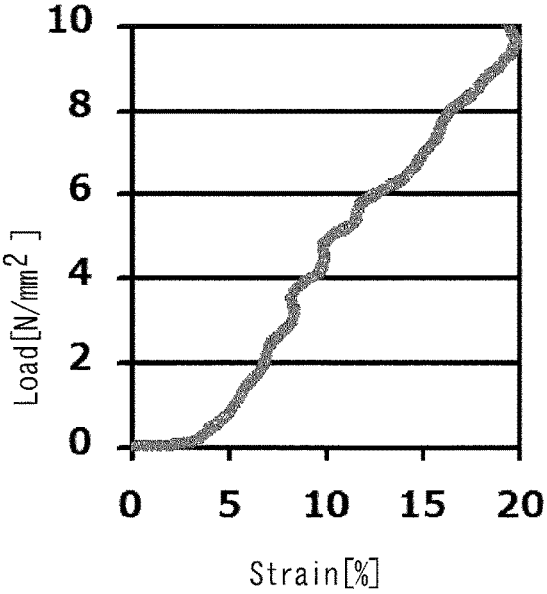
FIG. 13B is a graph showing the relationship between the stretch of a test specimen and the load.
Figure 13C:
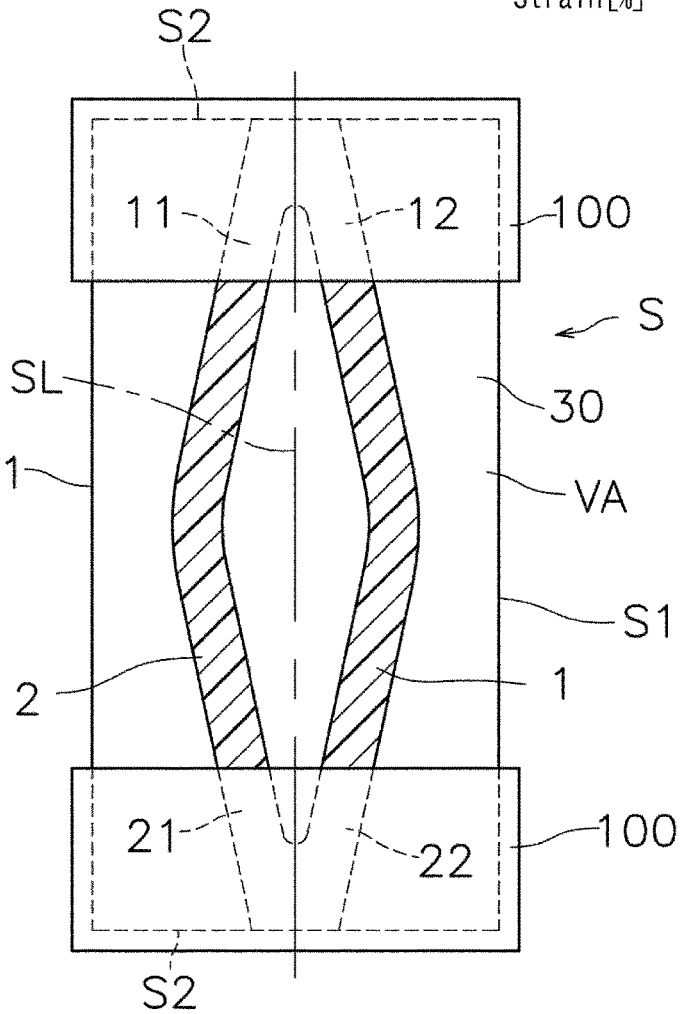
FIG. 13C is a front view showing the test specimen and the test method.
Figure 14A:
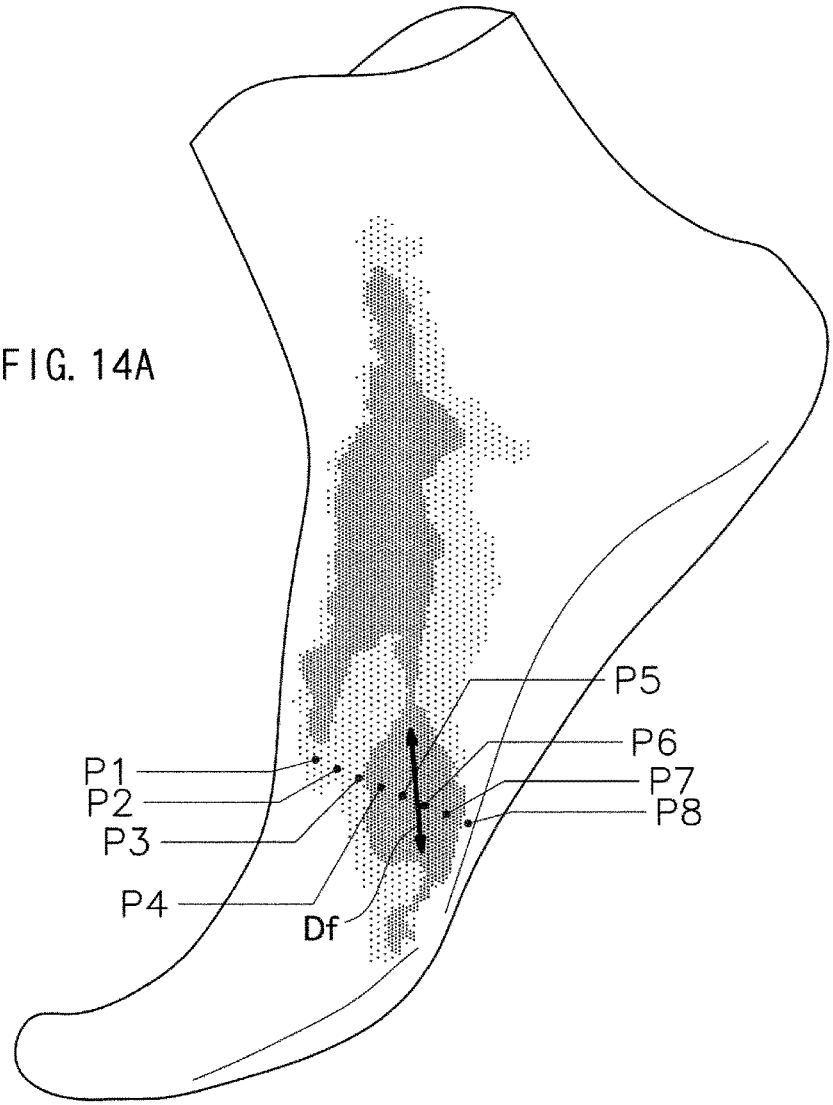
FIG. 14A is a medial side view of the foot showing the stretch of the surface of the foot.
Figure 14B:
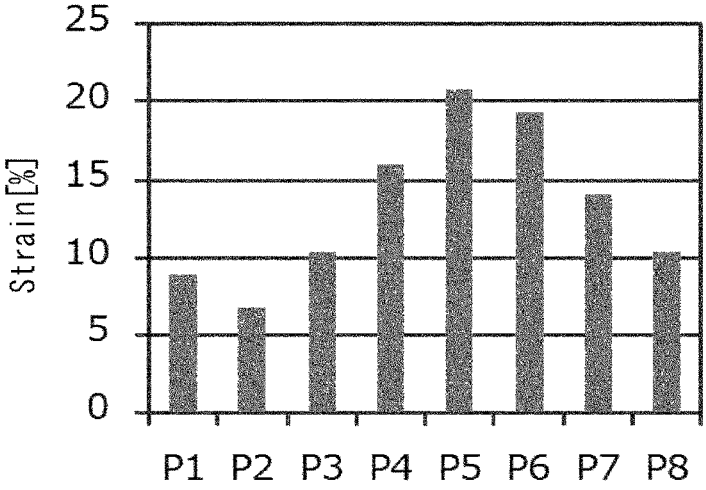
FIG. 14B is a bar chart quantitatively showing the measured value of the stretch for different positions of the foot.

In FIG. 13C, the virtual area VA is defined by a pair of long sides S1 extending along the virtual straight line SL and a pair of short sides S2 along another straight line (not shown) perpendicular to the virtual straight line SL, and the stiffness measurement is done by using a test specimen S having a rectangular shape so defined. The upper first end portion 11, 12 and the lower second end portion 21, 22 of each reinforcement portion 1, 2 is clamped by (the clamp of) a tensile tester 100, and a tensile load is applied thereon in the direction along which the virtual straight line SL extends.

Note that in the illustrated example, the virtual straight line SL coincides with the first center line C1 of FIG. 6. The test specimen S (FIG. 13C) was cut out from the upper of FIG. 1.

FIG. 13B shows the measurement results. In this case, the tensile stiffness of the test specimen S increased when the stretch of the test specimen S exceeded 3% to 4%.

Figure 15:
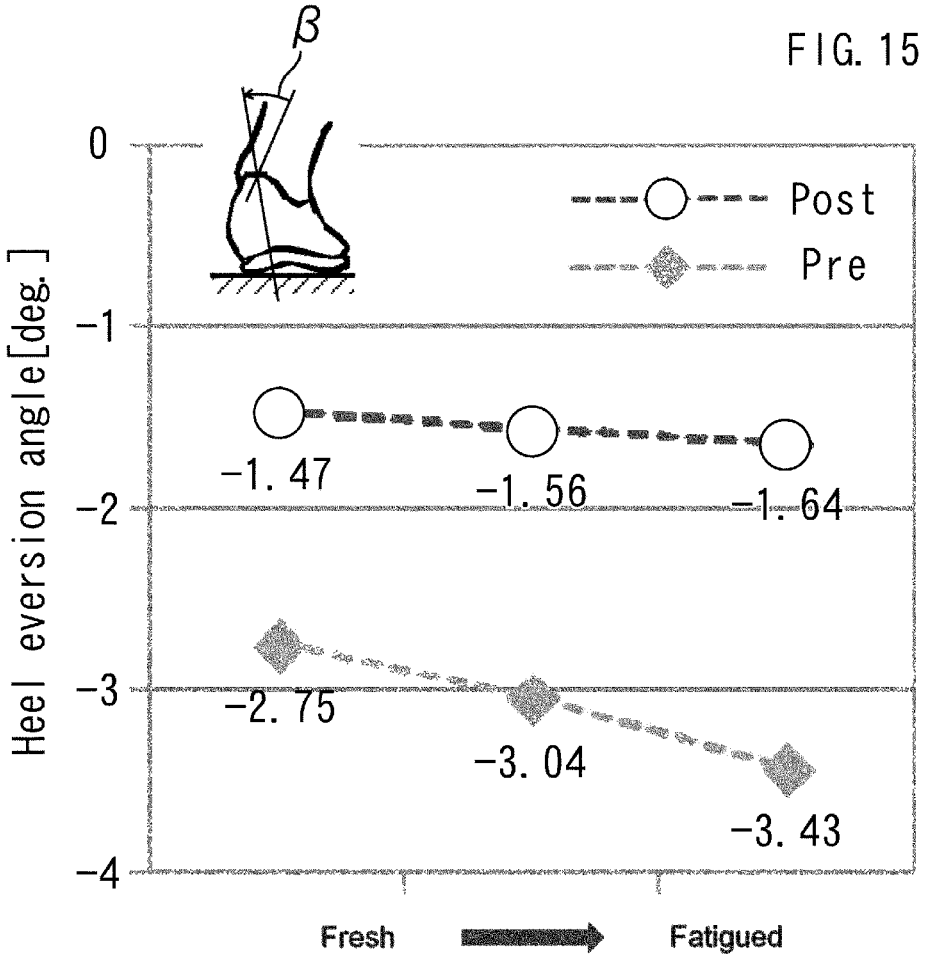
FIG. 15 is a graph showing the results of measuring the eversion angle β.

Next, the pronation-suppressing effect will be discussed with reference to FIG. 15. In FIG. 15, "Post" denotes a shoe having an upper as shown in FIG. 1, and "Pre" denotes a shoe without the improvement.

A comparison therebetween in FIG. 15 indicates that with the shoe illustrated in the example of FIG. 1, the absolute value of the eversion angle does not so much increase even when fatigued.

While preferred embodiments have been described above with reference to the drawings, various obvious changes and modifications will readily occur to those skilled in the art upon reading the present specification.

The sole placed under the upper may only include a so-called "outsole". The reinforced area may be provided on the medial side portion and on the lateral side portion. The reinforcement unit and the arch section may be absent.

Through holes allowing the shoelace to pass therethrough may be loops, or the like, instead of eyelets.

A belt as a fastening member may be employed instead of, or in addition to, the shoelace.

The meshed fabric included in the flexible member does not need to have an anisotropy, and it may have such an anisotropy that it stretches more easily in the up-down direction than in the front-rear direction.

Thus, such changes and modifications are deemed to fall within the scope of the present invention, which is defined by the appended claims.

INDUSTRIAL APPLICABILITY

The present invention is applicable to running shoes, and also to shoes of various other applications such as walking.

REFERENCE SIGNS LIST

1: First reinforcement portion, 2: Second reinforcement portion

11,12: First end portion, 1E: Posterior edge of first reinforcement portion, 1L: First envelope line

13: Upper end of first reinforcement portion, 14: Lower end of first reinforcement portion, 21,22: Second end portion, 23: Upper end of second reinforcement portion, 24: Lower end of second reinforcement portion, 2E: Anterior edge of second reinforcement portion

2L: Second envelope line

3: Upper, 3E: Upper edge, 3H: Through hole, 30: Flexible member, 31 to 33: First to third flexible portion, 34: Film, 35: Interior member, 36: Backer member

37: Upper edge, 38: Boundary portion, 39: Tongue, 3F: Surface of flexible member

4: Reinforced area, 41: First portion, 42: Second portion, 43: Upper end portion, 44: Lower end portion

45: Intermediate portion, 46: Bend portion, 4L: Length of area, 4W: Width of area

4F: Anterior edge defined by first envelope line, 4R: Posterior edge defined by second envelope line

51: First upper portion, 52: First lower portion, 53: Second upper portion, 54: Second lower portion

7: Mouth

8: Sole, 80: Midsole, 81: Upper surface of sole, 82: Insole

83: Outsole, 89: Reinforcement unit, 8F: Tread surface

100: Tensile tester

VA: Virtual area

B1: First metatarsal bone, B11: Shaft, B12: First proximal phalanx, B13: Medial cuneiform bone C1: First center line, C2: Second center line D1: Direction along which center line extends, D2: Perpendicular direction F: Anterior, FE: Front end, H: Engagement portion, L: Virtual horizontal line O: Ball of big toe O1: First bend point, O2: Second bend point, O3,O4: Midpoint R: Posterior S: Test specimen, SL: Virtual straight line, 51: Long side, S2: Short side Y: Up-down direction, X: Front-rear direction $\alpha$,$\alpha$1,$\alpha$2,$\alpha$3,$\alpha$4,$\Delta$i: Angle

The invention claimed is:

1. A shoe having an upper and a sole, the shoe comprising:

a flexible member forming a part of the upper and adapted to cover a medial side surface of a foot; and first and second reinforcement portions being less stretchable than the flexible member and attached to a surface of the flexible member, wherein:

the first reinforcement portion continuously or intermittently extends, in a band-shaped form or a linear-shaped form, upward from a boundary of the upper with respect to the sole;

the second reinforcement portion is placed posterior to the first reinforcement portion and continuously or intermittently extends, in a band-shaped form or a linear-shaped form, upward from the boundary of the upper with respect to the sole;

the flexible member has a reinforced area arranged between the first and the second reinforcement portions, an outermost surface of the reinforced area being the outermost surface of the flexible member between the first and the second reinforcement portions, the reinforced area being reinforced by the first and the second reinforcement portions;

the reinforced area is defined by (i) a first envelope line along a posterior edge of the first reinforcement portion and (ii) a second envelope line along an anterior edge of the second reinforcement portion;

the reinforced area extends along a virtual first center line, which divides the reinforced area into (i) a first portion whose anterior edge is defined by the first envelope line and (ii) a second portion whose posterior edge is defined by the second envelope line;

the reinforced area includes an upper end portion, a lower end portion, and an intermediate portion between the upper end portion and the lower end portion;

a width of the reinforced area in a direction perpendicular to a direction along which the first center line extends is at maximum in the intermediate portion, the width of the reinforced area gradually decreasing toward the upper end portion from the intermediate portion, and the width of the reinforced area gradually decreasing toward the lower end portion from the intermediate portion; and the upper end portion of the reinforced area is placed anterior to the lower end portion of the reinforced area, wherein: respective upper ends of the first and the second reinforcement portions are continuous with an engagement portion configured to receive a shoelace, and respective lower ends of the first and the second reinforcement portions are continuous with an upper surface of the sole;

the first envelope line along the posterior edge of the first reinforcement portion includes a first bend point at which the first envelope line bends, the first bend point located above the boundary and below an upper edge of the upper;

the second envelope line along the anterior edge of the second reinforcement portion includes a second bend point at which the second envelope line bends, the second bend point located above the boundary and below the upper edge of the upper;

an interior angle formed between the first reinforcement portion and the second reinforcement portion, measured by the upper end of the first reinforcement portion and the upper end of the second reinforcement portion, is an acute angle;

an interior angle formed between the first reinforcement portion and the second reinforcement portion, measured by the lower end of the first reinforcement portion and the lower end of the second reinforcement portion, is an acute angle;

an interior angle formed by the first reinforcement portion at the first bend point is an obtuse angle; and an interior angle formed by the second reinforcement portion at the second bend point is an obtuse angle.

2. A shoe having an upper and a sole, the shoe comprising:

a flexible member forming a part of the upper and adapted to cover a medial side surface of a foot; and first and second reinforcement portions being less stretchable than the flexible member and attached to a surface of the flexible member, wherein:

the first reinforcement portion continuously or intermittently extends, in a band-shaped form or a linear-shaped form, upward from a boundary of the upper with respect to the sole;

the second reinforcement portion is placed posterior to the first reinforcement portion and continuously or intermittently extends, in a band-shaped form or a linear-shaped form, upward from the boundary of the upper with respect to the sole;

the flexible member has a reinforced area arranged between the first and the second reinforcement portions, an outermost surface of the reinforced area being the outermost surface of the flexible member between the first and the second reinforcement portions, the reinforced area being reinforced by the first and the second reinforcement portions;

the reinforced area is defined by (i) a first envelope line along a posterior edge of the first reinforcement portion and (ii) a second envelope line along an anterior edge of the second reinforcement portion;

the reinforced area extends along a virtual first center line, which divides the reinforced area into (i) a first portion whose anterior edge is defined by the first envelope line and (ii) a second portion whose posterior edge is defined by the second envelope line;

the reinforced area includes an upper end portion, a lower end portion, and an intermediate portion between the upper end portion and the lower end portion;

a width of the reinforced area in a direction perpendicular to a direction along which the first center line extends is at maximum in the intermediate portion, the width of the reinforced area gradually decreasing toward the upper end portion from the intermediate portion, and the width of the reinforced area gradually decreasing toward the lower end portion from the intermediate portion;

the upper end portion of the reinforced area is placed anterior to the lower end portion of the reinforced area;

the first and the second reinforcement portions form a quadrangle frame surrounding the reinforced area;

the reinforced area is defined as a quadrilateral shape by the first and the second reinforcement portions; and a length of the reinforced area in the direction along which the virtual first center line extends is greater than the maximum width of the reinforced area, wherein:

the first envelope line along the posterior edge of the first reinforcement portion includes a first bend point at which the first envelope line bends, the first bend point located above the boundary and below an upper edge of the upper;

the second envelope line along the anterior edge of the second reinforcement portion includes a second bend point at which the second envelope line bends, the second bend point located above the boundary and below the upper edge of the upper;

an interior angle formed between the first reinforcement portion and the second reinforcement portion, measured by the upper end of the first reinforcement portion and the upper end of the second reinforcement portion, is an acute angle;

an interior angle formed between the first reinforcement portion and the second reinforcement portion, measured by the lower end of the first reinforcement portion and the lower end of the second reinforcement portion, is an acute angle;

an interior angle formed by the first reinforcement portion at the first bend point is an obtuse angle; and an interior angle formed by the second reinforcement portion at the second bend point is an obtuse angle.

3. A shoe having an upper and a sole, the shoe comprising:

a flexible member forming a part of the upper and adapted to cover a medial side surface of a foot; and first and second reinforcement portions being less stretchable than the flexible member and attached to a surface of the flexible member, wherein:

the first reinforcement portion continuously or intermittently extends, in a band-shaped form or a linear-shaped form, upward from a boundary of the upper with respect to the sole;

the second reinforcement portion is placed posterior to the first reinforcement portion and continuously or intermittently extends, in a band-shaped form or a linear-shaped form, upward from the boundary of the upper with respect to the sole;

the flexible member has a reinforced area arranged between the first and the second reinforcement portions, an outermost surface of the reinforced area being the outermost surface of the flexible member between the first and the second reinforcement portions, the reinforced area being reinforced by the first and the second reinforcement portions;

the reinforced area is defined by (i) a first envelope line along a posterior edge of the first reinforcement portion and (ii) a second envelope line along an anterior edge of the second reinforcement portion;

the reinforced area extends along a virtual first center line, which divides the reinforced area into (i) a first portion whose anterior edge is defined by the first envelope line and (ii) a second portion whose posterior edge is defined by the second envelope line;

the reinforced area includes an upper end portion, a lower end portion, and an intermediate portion between the upper end portion and the lower end portion;

a width of the reinforced area in a direction perpendicular to a direction along which the first center line extends gradually decreases toward the lower end portion from the intermediate portion; and the upper end portion of the reinforced area is placed anterior to the lower end portion of the reinforced area, wherein: an upper end of the first reinforcement portion is continuous with a first engagement portion configured to receive a shoelace, and an upper end of the second reinforcement portion is continuous with a second engagement portion configured to receive the shoelace, the second engagement portion being spaced apart from the first engagement portion in the direction perpendicular to the direction along which the first center line extends;

respective lower ends of the first and the second reinforcement portions are continuous with an upper surface of the sole;

the first envelope line along the posterior edge of the first reinforcement portion includes a first bend point at which the first envelope line bends, the first bend point located above the boundary and below an upper edge of the upper;

the second envelope line along the anterior edge of the second reinforcement portion includes a second bend point at which the second envelope line bends, the second bend point located above the boundary and below the upper edge of the upper;

an interior angle formed between the first reinforcement portion and the second reinforcement portion, measured by the lower end of the first reinforcement portion and the lower end of the second reinforcement portion, is an acute angle;

an interior angle formed by the first reinforcement portion at the first bend point is an obtuse angle; and an interior angle formed by the second reinforcement portion at the second bend point is an obtuse angle.

4. The shoe according to claim 3, wherein the first engagement portion and the second engagement portion are adjacent to each other in the direction perpendicular to the direction along which the first center line extends.

5. The shoe according to claim 4, wherein the width of the reinforced area is larger in the upper end portion than in the lower end portion.

6. The shoe according to claim 5, wherein the first envelope line and the second envelope line are connected with each other.

7. The shoe according to claim 3, wherein at least one of the first and the second reinforcement portions is formed in an S-letter shape.

8. The shoe according to claim 7, wherein in the intermediate portion the first envelope line and the second envelope line extend in parallel with each other and extend obliquely upward in a forward direction.

9. The shoe according to claim 7, wherein in the upper end portion the first envelope line and the second envelope line extend in parallel with each other and extend obliquely upward in a forward direction.

* * * * *